US006799874B2

(12) United States Patent
Nakata

(10) Patent No.: US 6,799,874 B2
(45) Date of Patent: Oct. 5, 2004

(54) AUTOMOBILE HEADLAMP HAVING A MAIN REFLECTOR AND A MOVABLE SUB-REFLECTOR

(75) Inventor: Yutaka Nakata, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 95 days.

(21) Appl. No.: 10/164,703

(22) Filed: Jun. 10, 2002

(65) Prior Publication Data

US 2003/0007364 A1 Jan. 9, 2003

(30) Foreign Application Priority Data

Jun. 12, 2001 (JP) ..... 2001-177740

(51) Int. Cl.[7] ..... F21V 7/10

(52) U.S. Cl. ..... 362/514; 362/277; 362/464; 362/517

(58) Field of Search ..... 362/459, 464, 362/465, 466, 467, 469, 487, 506, 507, 509, 512, 514, 517, 538, 257, 269, 276, 277, 280, 282, 283, 284, 296, 297

(56) References Cited

U.S. PATENT DOCUMENTS

| | | | | |
|---|---|---|---|---|
| 1,834,542 A | * | 12/1931 | Karlebo | 362/514 |
| 2,228,329 A | * | 1/1941 | Reynolds | 362/514 |
| 3,435,200 A | * | 3/1969 | Massoll et al. | 362/514 |
| 5,060,120 A | * | 10/1991 | Kobayashi et al. | 362/282 |
| 5,099,400 A | | 3/1992 | Lee | |
| 5,469,340 A | | 11/1995 | Heizmann | |
| 6,059,435 A | * | 5/2000 | Hamm et al. | 362/514 |
| 6,626,565 B2 | * | 9/2003 | Ishida | 382/514 |

FOREIGN PATENT DOCUMENTS

| | | | | |
|---|---|---|---|---|
| DE | 195 44 211 A1 | | 6/1996 | |
| EP | 0 419 730 A1 | | 4/1991 | |
| EP | 1 070 912 | | 1/2001 | |
| JP | 6-7105 | | 1/1994 | |
| JP | 7-304384 | | 11/1995 | |
| JP | 2000-133026 | | 5/2000 | |
| JP | 2001-35215 | | 2/2001 | |
| JP | 2002216506 A | * | 8/2002 | F21S/8/10 |

OTHER PUBLICATIONS

D. Rogers et al., "Mathematical Elements for Computer Graphics", Second Edition, McGraw–Hill, 1990, pp. 445–446.

* cited by examiner

*Primary Examiner*—Thomas M. Sember
*Assistant Examiner*—Ismael Negron
(74) *Attorney, Agent, or Firm*—Foley & Lardner LLP

(57) ABSTRACT

A headlamp that is installed at the front of an automobile, such headlamp including a light source, a main reflector, and a sub reflector. When the light source is turned on the headlamp reflects the light from the light source with the main reflector and the sub reflector to illuminate a road surface in a target luminous intensity distribution pattern, and chances the luminous intensity distribution pattern by moving the sub reflector. The main reflector and the sub reflector are prepared based on a composite combination of reflection surfaces of free curved surfaces. The sub reflector is movably disposed at a position where the light from the light source is directly incident to the sub reflectors and also at the position where the sub reflector does not interrupt a light path through which the light from the light source is incident to the main reflector.

20 Claims, 25 Drawing Sheets

AUTOMOBILE HEADLAMP HAVING A MAIN REFLECTOR AND A MOVABLE SUB-REFLECTOR

FIELD OF THE INVENTION

The present invention relates to a headlamp that is installed on the front of an automobile and is used to illuminate the road surface and the like. Particularly, the invention relates to a headlamp that can effectively utilize the light from the light source.

BACKGROUND OF THE INVENTION

In the present specification and claims, "a road surface and the like" refers to a road surface and persons and objects on the road surface.

In recent years, there have been developed headlamps of which luminous intensity distribution pattern changes based on the move of a sub reflector.

A headlamp of this type has been disclosed, for example, in U.S. Pat. No. 5,060,120. This headlamp includes a light source, a fixed main reflector, and a movable sub reflector. When the light source of this headlamp has been turned on, the main reflector and the sub reflector reflect the light emitted from the light source. The reflected light irradiates the road surface and the like in a target luminous intensity distribution pattern. The luminous intensity distribution pattern changes based on a move of the sub reflector. According to this headlamp, apart of the main reflector forms a reflection surface that reflects the light from the light source to the sub reflector.

SUMMARY OF THE INVENTION

The present invention relates to an improvement in the headlamp, and has an object of providing a headlamp that can effectively utilize the light from the light source.

In order to achieve the above object, according to the present invention, a main reflector and a sub reflector are prepared based on a composite combination of reflection surfaces of free curved surfaces. The sub reflector is movably disposed at a position where the light from the light source is directly incident to the sub reflector, and also at the position where the sub reflector does not interrupt a light path through which the light from the light source is incident to the main reflector.

As a result, according to the present invention, the light from the light source is directly incident to the sub reflector, and also the light from the light source is incident to the total reflection surface of the main reflector without being interrupted by the sub reflector. Therefore, it is possible to effectively utilize the light from the light source.

Other objects and features of this invention will become understood from the following description with reference to the accompanying drawings.

DETAILED DESCRIPTIONS

Figure 1:
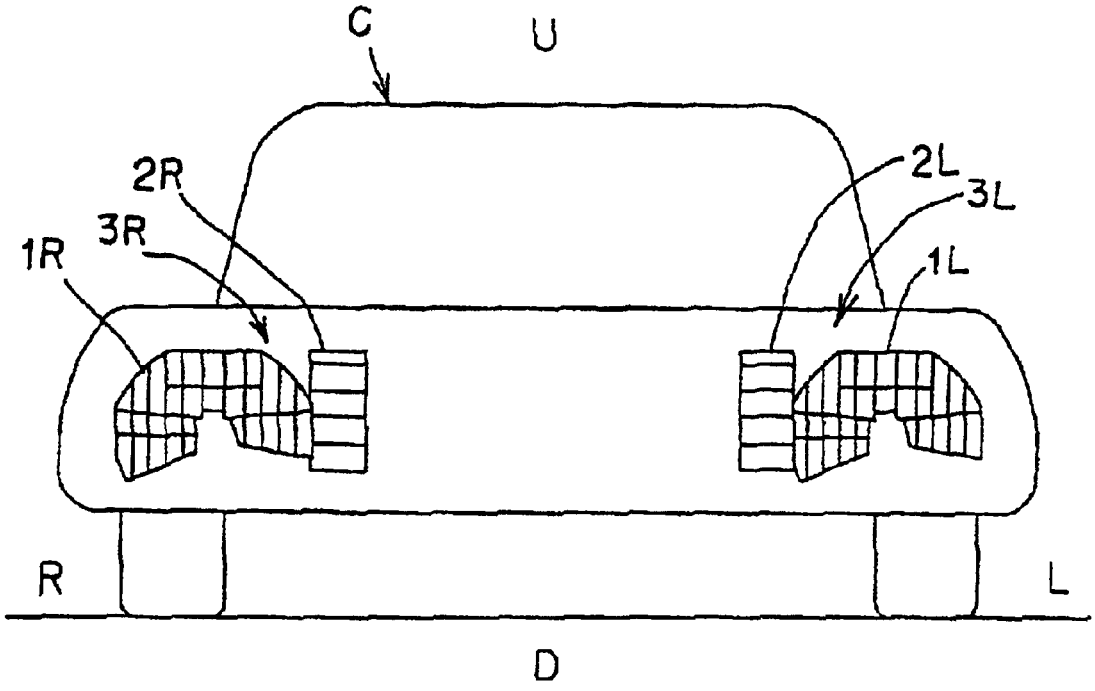
FIG. 1 is a front view of an automobile which shows an outline status that the automobile is mounted with headlamps relating to an embodiment of the present invention.

Embodiment of the headlamp relating to the present invention will be explained below with reference to the attached drawings. The present invention is not limited to these embodiments.

The headlamp relating to the present embodiment is installed on an automobile that runs on the left traffic zone. Therefore, a luminous intensity distribution pattern obtained by the headlamp that is installed on an automobile that runs on the right traffic zone becomes a luminous intensity distribution pattern of which left and right relationship is opposite to that obtained by the headlamp of the present embodiment.

The headlamp relating to the present embodiment is installed on both left and right sides at the front of an automobile that has a driving seat disposed on the right side (what is called a rightside steering wheel). Therefore, a luminous intensity distribution pattern obtained by the headlamp installed on both left and right sides at the front of an automobile that has a driving seat disposed on the left side (what is called a leftside steering wheel) becomes a luminous intensity distribution pattern of which left and right relationship is opposite to that obtained by the headlamp of the present embodiment.

In the drawings, a reference numeral "F" denotes a forward running direction of an automobile C, which is a forward direction as viewed from a driver. A reference numeral "B" denotes a direction opposite to the forward running direction of the automobile C, which is a backward direction as viewed from the driver. A reference numeral "U" denotes an upside as viewed from the driver. A reference numeral "D" denotes a downside as viewed from the driver. A reference numeral "L" denotes a leftside when the driver faces the forward direction of the automobile. A reference numeral "R" denotes a rightside when the driver faces the forward direction of the automobile. A reference numeral "Z-Z" denotes a light axis (a pseudo light axis) . A reference numeral "H-H" denotes a horizontal line (a horizontal axis). A reference numeral "V-V" denotes a vertical line (a vertical axis). A reference numeral "ZF-ZB" denotes a forward-and-backward light axis. A reference numeral "HL-HR" denotes a left-and-right horizontal line. A reference numeral "VU-VD" denotes an up-and-down verticalline.

An outline of the headlamp will be explained. FIG. 1 is a front view of an automobile which shows an outline status that the automobile is mounted with headlamps relating to the present embodiment. As shown in FIG. 1, headlamps 3L and 3R relating to the present embodiment are installed on both left and right sides at the front of the automobile C. The left headlamp 3L is provided with a left main reflector 1L as a fixed reflector, and a left sub reflector 2L as a variable reflector. Similarly, the right headlamp 3R is provided with a right main reflector 1R as a fixed reflector, and a right sub reflector 2R as a variable, reflector. The left sub reflector 2L and the right sub reflector 2R are disposed at the center side of the automobile C. The front of the automobile C forms a slanted shape from the center backward at both left and right ends as viewed from above the automobile (refer to FIG. 2).

Figure 2:
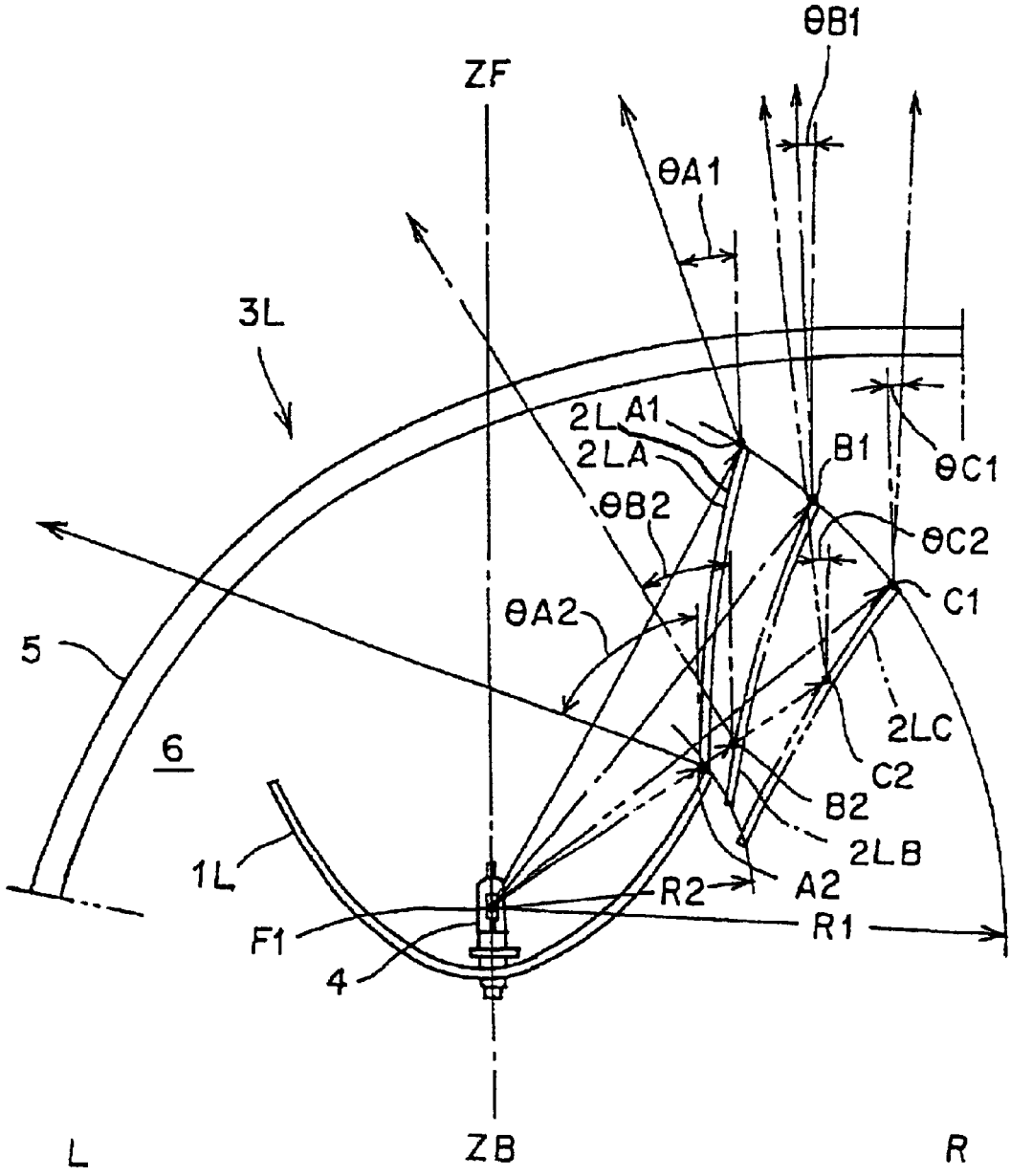
FIG. 2 is a lateral cross-sectional view of a left headlamp which shows a structure thereof.

The structures of the headlamps 3L and 3R relating to the present embodiment will be explained in detail. FIG. 2 is a lateral cross-sectional view of the left headlamp which shows a structure thereof. In FIG. 2, hatching is omitted to facilitate the understanding of a moving status and a light path of the left sub reflector 2L. FIG. 2 explains the left headlamp 3L. The right headlamp 3R has a structure symmetrical with the structure of the left headlamp 3L in left and right directions. Therefore, the explanation of the right headlamp 3R will be omitted.

The left headlamp 3L has a light source 4, The left main reflector 1L, the left sub reflector 2L, and a lamp lens 5. The lamp lens 5 is prepared using a light-passing member, and forms a light chamber 6 together with a lamp housing (not shown). This lamp lens 5 constitutes what is called an outer cover.

For the light source 4, there are used a discharging lamp (a high-tension metal deposited discharge lamp such as a metal halide lamp, and a high luminance discharge lamp (HID)), a tungsten halogen lamp and an incandescent lamp of a single filament or a double filament (what is called H1, H3, H4, H7, H1, etc.). This light source 4 is disposed within the light chamber 6.

The left main reflector 1L and the left sub reflector 2L are prepared based on a composite combination of reflection surfaces of free curved surfaces. The reflection surfaces of the left main reflector 1L and the left sub reflector 2L are formed based on aluminum deposition or silver coating. The left main reflector 1L is constructed of a plurality of segments, that is, thirty one segments (blocks of reflection surfaces) in vertical and lateral directions in this example. The left sub reflector 2L is constructed of a plurality of segments, that is, five segments (blocks of reflection surfaces) in this example. In the left main reflector 1L and the left sub reflector 2L, boundary lines of segments appear like in this example. The boundary lines of segments may not appear when the segments are continuous, that is, when the segments are formed continuously.

The left main reflector 1L and the left sub reflector 2L constructed of free curved surfaces are described in detail in "Mathematical Elements for Computer Graphics", by Devid F. Rogers, J. Alan Adams, for example. In other words, the left main reflector 1L and the left sub reflector 2L are constructed of free curved surfaces of NURBS (Non-Uniform Rational B-Spline Surface) (refer to Japanese Patent Application Laid-open No. 2001-35215).

The outline will be explained below. The reflection surfaces of the left main reflector 1L and the left sub reflector 2L are obtained from a general equation of the following equation (1). Parametric functions of the general equation of the equation (1) are given as the equation (2). By substituting detailed numerical values such as points on a paraboloid, for example, into the parametric functions of the equation (2), it is possible to obtain detailed reflection surfaces of the left main reflector 1L and the left sub reflector 2L.

$$P(u, v) = \sum_{j=0}^{m} \sum_{k=0}^{n} P_{j,k} N_{j,s}(u) N_{k,t}(v) \tag{1}$$

$$N_{j,s}(u) = \begin{cases} 1 \text{ (if } u_j \leqq u < u_{j+1}) \\ 0 \text{ (others)} \end{cases}$$

$$N_{j,s}(u) = \frac{u - u_j}{u_{j+s-1} - u_j} N_{j,s-1}(u) + \frac{u_{j+s} - u}{u_{j+s} - u_{j+1}} N_{j+1,s-1}(u)$$

$$N_{k,t}(v) = \begin{cases} 1 \text{ (if } v_k \leqq v < v_{k+1}) \\ 0 \text{ (others)} \end{cases}$$

$$N_{k,i}(v) = \frac{v - v_k}{v_{k+t-1} - v_k} N_{k,t-1}(v) + \frac{v_{k+t} - v}{v_{k+t} - v_{k+1}} N_{k+1,s-1}(v) \tag{2}$$

At a focal point F1 of the left main reflector 1L and the left sub reflector 2L, there is no single focal point in a strict sense. As there are minor differences between focal distances of a plurality of reflection surfaces, the focal points formed by these reflection surfaces share substantially the same one focal point. Therefore, this substantially the same one focal point will be called a pseudo focal point (or will be simply called a focal point) F1 in the present specification and drawings. Similarly, in the light axis Z-Z of the left main reflector 1L and the left sub reflector 2L, there is no single light axis in a strict sense. As there are minor differences between light axes of the plurality of reflection surfaces, the light axes formed by these reflection surfaces share substantially the same one light axis. Therefore, this substantially the same one light axis will be called a pseudo light axis (or will be simply called a light axis) Z-Z in the present specification and drawings.

By employing free curved surfaces of NURBS for the reflection surfaces of the left main reflector 1L and the left sub reflector 2L, it is possible to prepare these reflection surfaces of the left main reflector 1L and the left sub reflector 2L in high precision, at a high speed and with a high degree of freedom.

Figure 3:
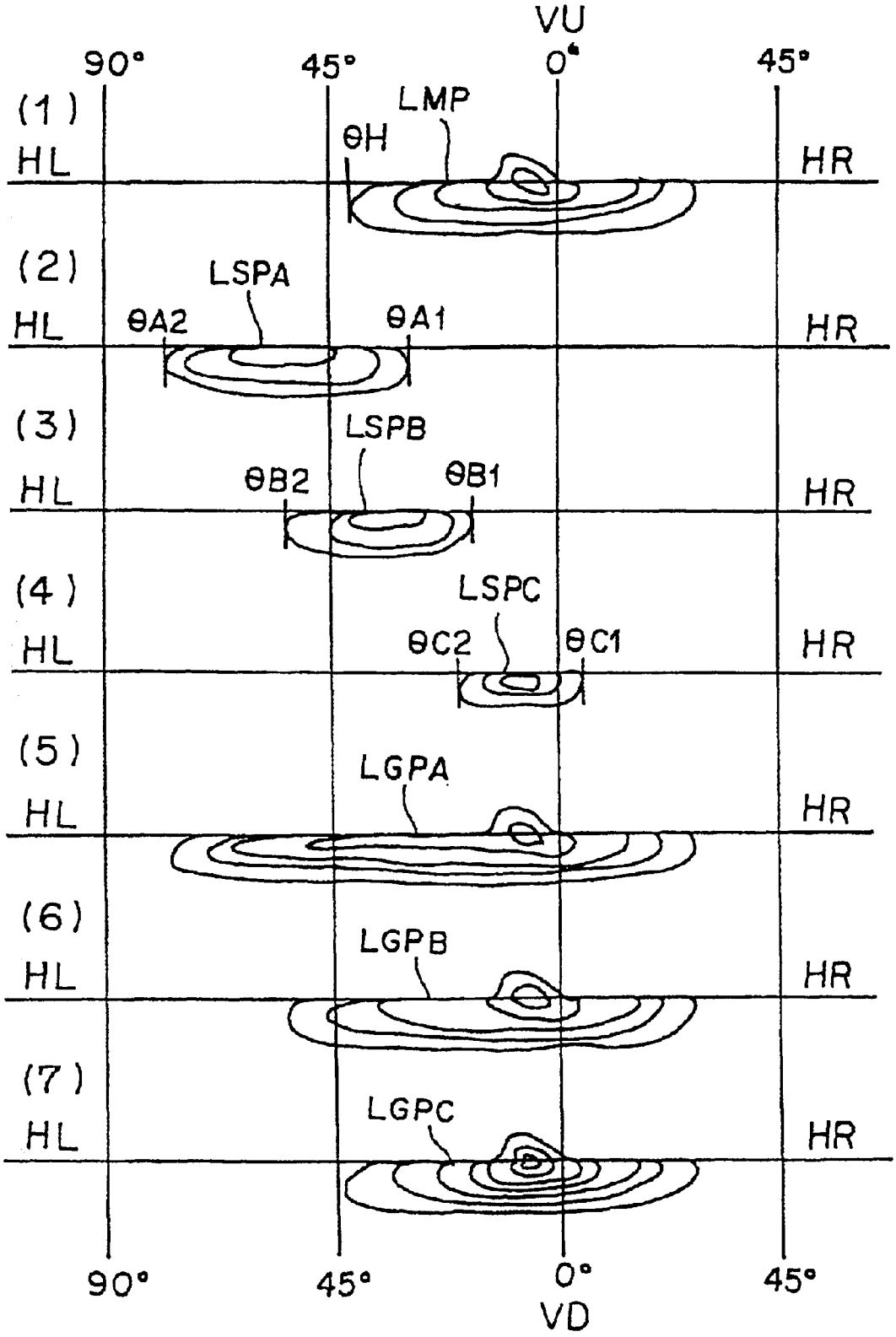
FIG. 3 shows image diagrams of luminous intensity distribution patterns formed by irradiating a reflection light from a main reflector and a reflection light from a sub reflector of a left headlamp respectively onto a screen and their combined luminous intensity distribution patterns.

Based on the left main reflector 1L and the left sub reflector 2L constructed of free curved surfaces, it is possible to obtain target luminous intensity distribution patterns. In other words, based on the left main reflector 1L, it is possible to obtain a basic luminous intensity distribution pattern LMP as shown in FIG. 3 line (1). The basic luminous intensity distribution pattern LMP shown in FIG. 3 line (1) is a luminous intensity distribution pattern that satisfies various standards. This luminous intensity distribution pattern is what is called a luminous intensity distribution pattern of a meeting mode. Further, based on the left sub reflector 2L, it is possible to obtain auxiliary luminous intensity distribution patterns LSPA, LSPB and LSPC as shown in FIG. 3 lines (2), (3) and (4). The luminous intensity distribution pattern LSPA shown in FIG. 3 line (2) is a luminous intensity distribution pattern in a status that the left sub reflector 2L is closed most (a status that the left sub reflector is located at the position A, which is indicated by a solid line with a reference number 2LA in FIG. 2). This is a luminous intensity distribution pattern of what is called a spread mode. The luminous intensity distribution pattern LSPC shown in FIG. 3 line (4) is a luminous intensity distribution pattern in a status that a left sub reflector 2LC is opened most (a status that the left sub reflector is located at the position C, which is indicated by a two-point chain line with a reference number 2LC in FIG. 2). This is a luminous intensity distribution pattern of what is called a condensation mode. Further, the luminous intensity distribution pattern LSPB shown in FIG. 3 line (3) is a luminous intensity distribution pattern in a status that a left sub reflector 2LB is located between the position A and the position C (a status that the left sub reflector is located at the position B, which is indicated by a one-point chain line with a reference number 2LB in FIG. 2). This is a luminous intensity distribution pattern of an intermediate mode between the spread mode and the condensation mode.

Figure 4:
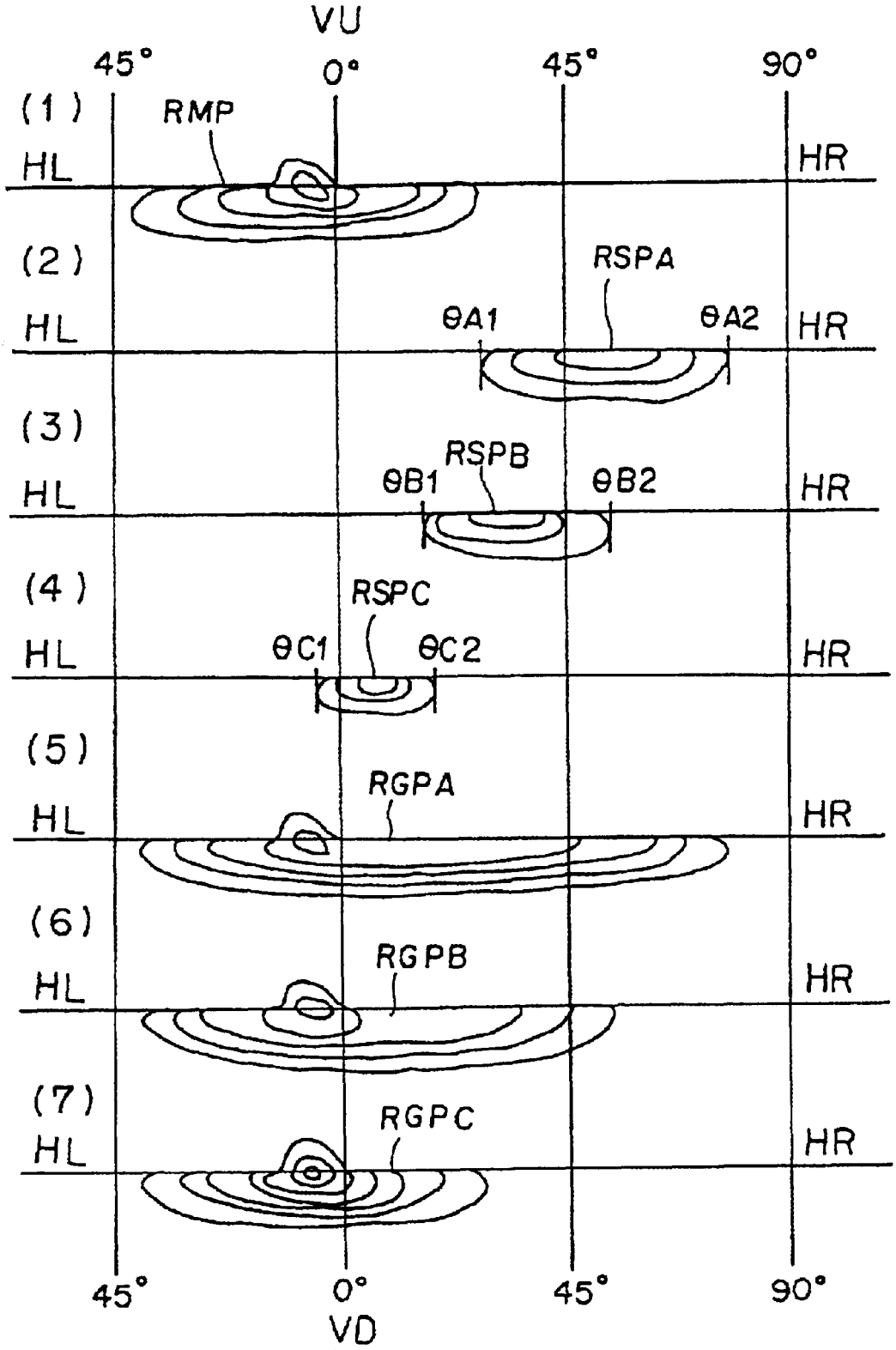
FIG. 4 shows image diagrams of luminous intensity distribution patterns formed by irradiating a reflection light from a main reflector and a reflection light from a sub reflector of a right headlamp respectively onto a screen and their combined luminous intensity distribution patterns.

The left headlamp 3R can also obtain target luminous intensity distribution patterns in a similar manner. In other words, the right main reflector 1R obtains a basic luminous intensity distribution pattern RMP shown in FIG. 4 line (1), and the right sub reflector 2R obtains auxiliary luminous intensity distribution patterns RSPA, RSPB and RSPC as shown in FIG. 4 lines (2), (3) and (4).

As shown in FIG. 2, the left sub reflector 2L is movably disposed on the right side of the left main reflector 1L, that is, at the center side of the automobile C. In the case of the right headlamp 3R, the right sub reflector 2R is movably disposed on the left side of the right main reflector 1R. In this example, the left sub reflector 2L is disposed rotatably around a vertical rotation axis (not shown) around the light source 4 or the focal point F1. One end of the left sub reflector 2L draws a track of an arc having a radius R1, and the other end of the left sub reflector 2L draws a track of an arc having a radius R2. In other words, the left sub reflector 2L moves between the arc having the radius R1 and the arc having the radius R2.

For a driving unit that rotates the left sub reflector 2L, any one of a motor, a stepping motor, a solenoid, and an air cylinder is used. For a control unit that controls the rotation of the left sub reflector 2L, a manual switch based on a hand operation of a driver or an automatic switch that is linked with a steering sensor or a speed sensor is used.

Light paths of a reflection light from the light source 4 when the left sub reflector 2L is located at the position A, the position B and the position C will be explained with reference to FIG. 2.

A light path of a reflection light when the left sub reflector 2L is located at the position A will be explained. A light (indicated by a solid line arrow mark) from the light source 4 which has entered one end A1 of the left sub reflector 2LA located at the position A is reflected at an angle θA1. A light (indicated by a solid line arrow mark) that connects between the light source 4 and the right end of the left main reflector 1L and that has entered the other end A2 of the left sub reflector 2LA, is reflected at an angleθA2. As a result, the luminous intensity distribution pattern LSPA of the desired spread mode is obtained as shown by the luminous intensity distribution pattern in FIG. 3 line (2).

A light path of a reflection light when the left sub reflector 2L is located at the position B will be explained. A light (indicated by a one-point chain line arrow mark) from the light source 4 which has entered one end B1 of the left sub reflector 2LB located at the position B is reflected at an angle θB1. A light (indicated by a one-point chain line arrow mark) that connects between the light source 4 and the right end of the left main reflector 1L and that has entered the other end B2 of the left sub reflector 2LB, is reflected at an angleθB2. As a result, the luminous intensity distribution pattern LSPB of the desired intermediate mode between the spread mode and the condensation mode is obtained as shown by the luminous intensity distribution pattern in FIG. 3 line (3). This intermediate luminous intensity distribution pattern LSPB continuously changes by rotating the left sub reflector 2L.

A light path of a reflection light when the left sub reflector 2L is located at the position C will be explained. A light (indicated by a two-point chain line arrow mark) from the light source 4 which has entered one end C1 of the left sub reflector 2LC located at the position C is reflected at an angle θC1. A light (indicated by a two-point chain line arrow mark) that connects between the light source 4 and the right end of the left main reflector 1L and that has entered an intermediate portion C2 of the left sub reflector 2LC, is reflected at an angleθC2. As a result, the luminous intensity distribution pattern LSPC of the desired condensation mode is obtained as shown by the luminous intensity distribution pattern in FIG. 3 line (4).

Relationships between the reflectors and the luminous intensity distribution patterns will be explained with reference to FIG. 3 (lines (1) to (7)) to FIG. 10.

FIG. 3 line (1) is an image diagram which shows a luminous intensity distribution pattern formed by irradiating a reflection light from the left main reflector 1L of the left headlamp 3L onto a screen. FIG. 3 line (2) is an image diagram which shows a luminous intensity distribution pattern formed by irradiating a reflection light from the left sub reflector 2LA located at the position A onto a screen. FIG. 3 line (3) is an image diagram which shows a luminous intensity distribution pattern formed by irradiating a reflection light from the left sub reflector 2LB located at the position B onto a screen. FIG. 3 line (4) is an image diagram which shows a luminous intensity distribution pattern formed by irradiating a reflection light from the left sub reflector 2LC located at the position C onto a screen. FIG. 3 line (5) is an image diagram which shows a luminous intensity distribution pattern which is a combination of the luminous intensity distribution pattern shown in FIG. 3 line (1) and the luminous intensity distribution pattern shown in FIG. 3 line (2). FIG. 3 line (6) is an image diagram which shows a luminous intensity distribution pattern which is a combination of the luminous intensity distribution pattern shown in FIG. 3 line (1) and the luminous intensity distribution pattern shown in FIG. 3 line (3). FIG. 3 line (7) is an image diagram which shows a luminous intensity distribution pattern which is a combination of the luminous intensity distribution pattern shown in FIG. 3 line (1) and the luminous intensity distribution pattern shown in FIG. 3 line (4).

FIG. 4 line (1) is an image diagram which shows a luminous intensity distribution pattern formed by irradiating a reflection light from the left main reflector 1R of the right headlamp 3R onto a screen. FIG. 4 line (2) is an image diagram which shows a luminous intensity distribution pattern formed by irradiating a reflection light from a right sub reflector 2RA located at the position A onto a screen. FIG. 4 line (3) is an image diagram which shows a luminous intensity distribution pattern formed by irradiating a reflection light from a right sub reflector 2RB located at the position B onto a screen. FIG. 4 line (4) is an image diagram which shows a luminous intensity distribution pattern formed by irradiating a reflection light from a right sub reflector 2RC located at the position C onto a screen. FIG. 4 line (5) is an image diagram which shows a luminous intensity distribution pattern which is a combination of the luminous intensity distribution pattern shown in FIG. 4 line (1) and the luminous intensity distribution pattern shown in FIG. 4 line (2). FIG. 4 line (6) is an image diagram which shows a luminous intensity distribution pattern which is a combination of the luminous intensity distribution pattern shown in FIG. 4 line (1) and the luminous intensity distribution pattern shown in FIG. 4 line (3). FIG. 4 line (7) is an image diagram which shows a luminous intensity distribution pattern which is a combination of the luminous intensity distribution pattern shown in FIG. 4 line (1) and the luminous intensity distribution pattern shown in FIG. 4 line (4).

Figure 5:
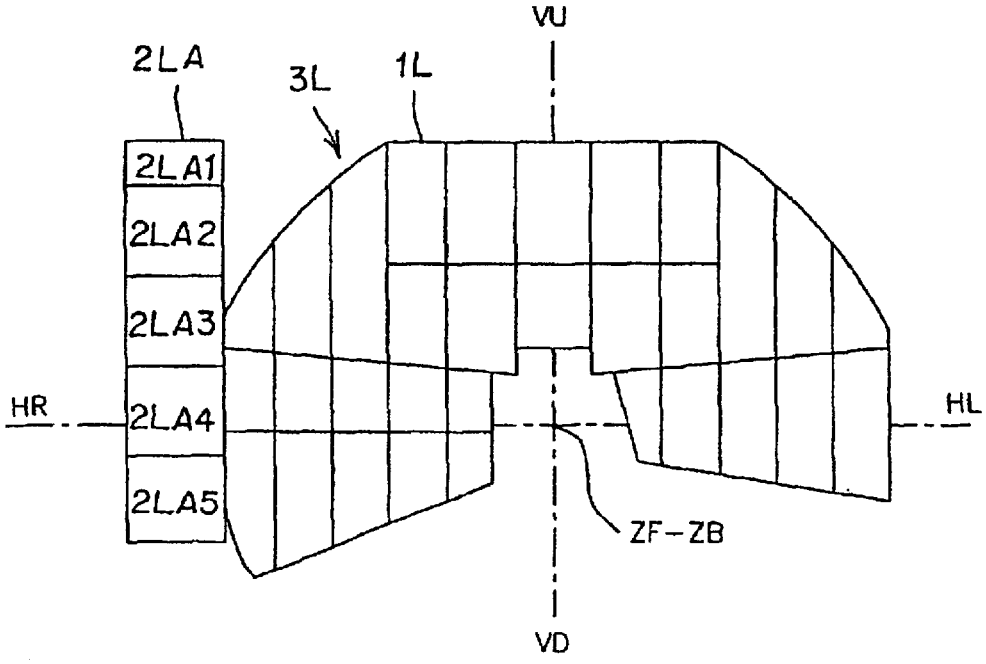
FIG. 5 is a front view of the left headlamp which shows an outline status that the sub reflector is located at a first position (hereinafter to be referred to as a position A)
Figure 6:
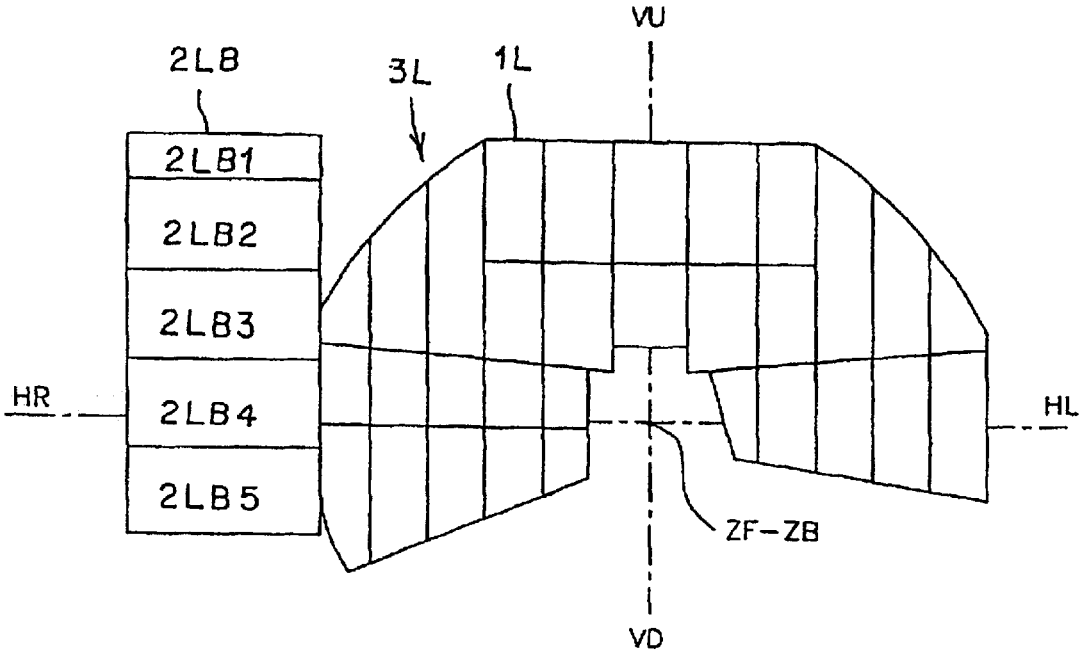
FIG. 6 is a front view of the left headlamp which shows an outline status that the sub reflector is located at a position B.
Figure 7:
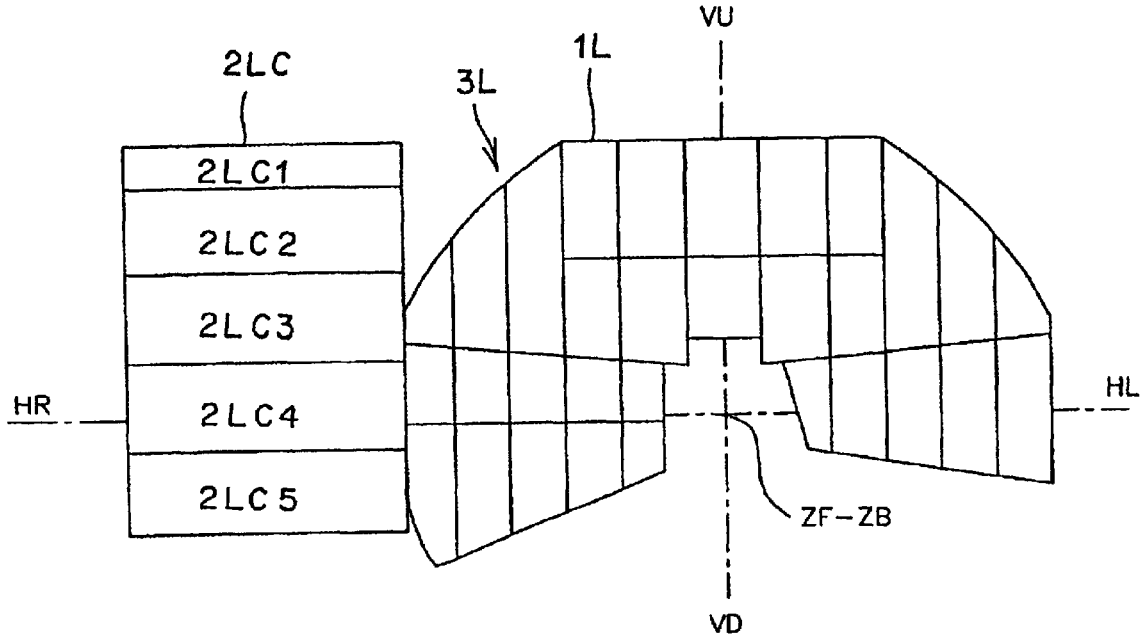
FIG. 7 is a front view of the left headlamp which shows an outline status that the sub reflector is located at a second position (hereinafter to be referred to as a position C)
Figure 8:
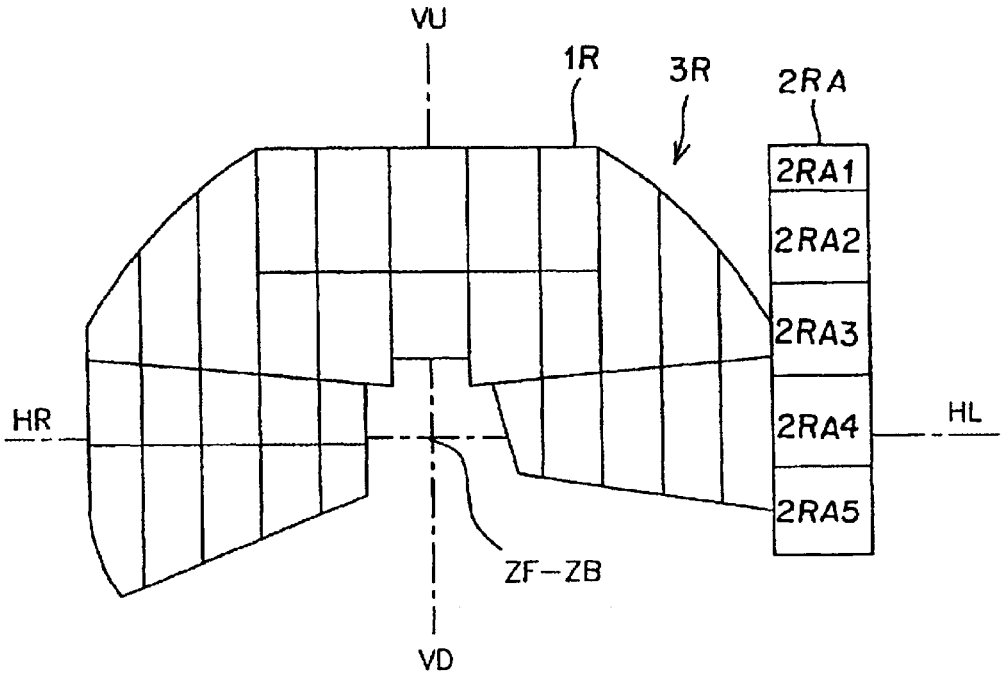
FIG. 8 is a front view of the right headlamp which shows an outline status that the sub reflector is located at the position A.
Figure 9:
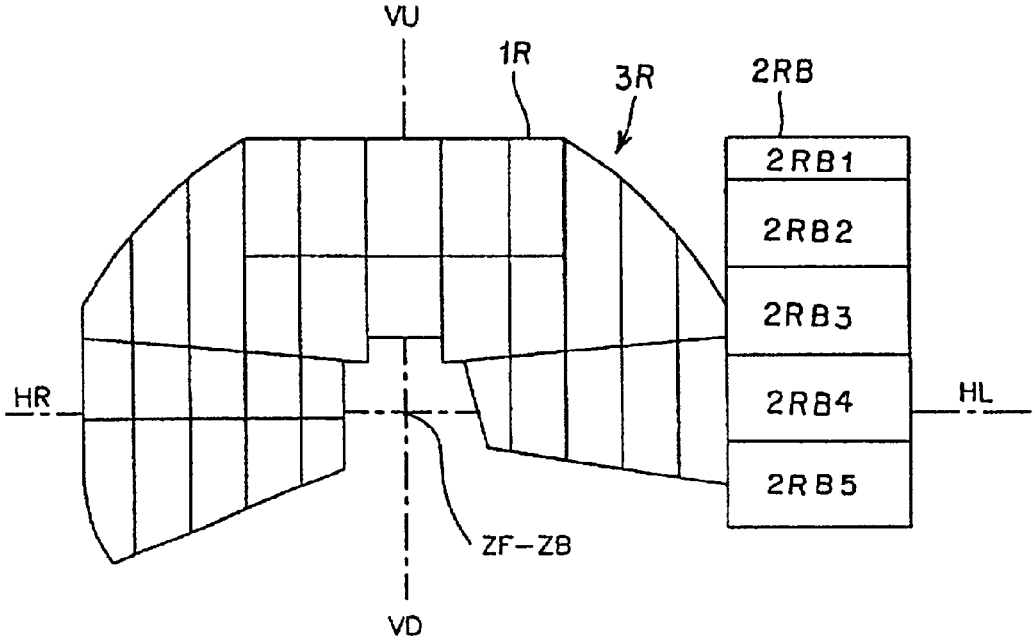
FIG. 9 is a front view of the right headlamp which shows an outline status that the sub reflector is located at the position B.

FIG. 5 is a front view of the left headlamp 3L which shows an outline status that the left sub reflector 2LA is located at the position A. FIG. 6 is a front view of the left headlamp 3L which shows an outline status that the left sub reflector 2LB is located at the position B. FIG. 7 is a front view of the left headlamp 3L which shows an outline status that the left sub reflector 2LC is located at the position C. FIG. 8 is a front view of the right headlamp 3R which shows an outline status that the left sub reflector 2RA is located at the position A. FIG. 9 is a front view of the right headlamp 3R which shows an outline status that the left sub reflector 2RB is located at the position B. FIG. 10 is a front view of the right headlamp 3R which shows an outline status that the left sub reflector 2RC is located at the position C.

When the left sub reflector 2L of the left headlamp 3L is located at the position A, the left sub reflector 2LA is in the closed status as shown in FIG. 2 and FIG. 5. At this time, the luminous intensity distribution pattern LSPA of the spread mode as shown in FIG. 3 line (2) is obtained as the reflection light from the left sub reflector 2LA. The luminous intensity distribution pattern LSPA of the spread mode and the luminous intensity distribution pattern LMP (refer to FIG. 3 line (1)) obtained by the left main reflector 1L are combined together, and a combined luminous intensity distribution pattern LGPA of a spread type as shown in FIG. 3 line (5) is obtained as a result.

In other words, as shown in FIG. 3 line (1) and (2), the reflection angle θA1 at one end A1 of the left sub reflector 2LA is slightly smaller than a reflection angle θH at the left end of the left main reflector 1L. Further, the reflection angle θA2 at the other end A2 of the left sub reflector 2LA is much larger than the reflection angle θA1 at one end A1 of the left sub reflector 2LA and the reflection angle θH at the left end of the left main reflector 1L. Consequently, as shown in FIG. 3 line (5), the right end portion of the luminous intensity distribution pattern LSPA in the spread mode of the left sub reflector 2LA is superimposed with the left end portion of the basic luminous intensity distribution pattern LMP of the left main reflector 1L. Further, the left end portion of the luminous intensity distribution pattern LSPA in the spread mode of the left sub reflector 2LA is spread in the leftside. As a result, the combined luminous intensity distribution pattern LGPA of the spread type is obtained.

When the left sub reflector 2L is located at the position C, the left sub reflector 2LC is in the opened status as shown in FIG. 2 and FIG. 7. At this time, the luminous intensity distribution pattern LSPC of the condensation mode as shown in FIG. 3 line (4) is obtained as the reflection light from the left sub reflector 2LC. The luminous intensity distribution pattern LSPC of the condensation mode and the luminous intensity distribution pattern LMP (refer to FIG. 3 line (1)) obtained by the left main reflector 1L are combined together, and a combined luminous intensity distribution pattern LGPC of a condensation type as shown in FIG. 3 line (7) is obtained as a result.

In other words, as shown in FIG. 3 lines (1) and (4), the reflection angle θC1 at one end C1 of the left sub reflector 2LC is located at the right side of the vicinity of the center (VU-VD). As shown in FIG. 2, the other end portion of the left sub reflector 2LC is hidden at the backside of the left main reflector 1L. Further, the reflection angle θC2 at the other end C2 of the portion of the left sub reflector 2LC that appears at the front side of the left main reflector 1L is located at the left side of the vicinity of the center (VU-VD). Consequently, as shown in FIG. 3 line (7), the left end portion of the luminous intensity distribution pattern LSPC in the condensation mode of the left sub reflector 2LC is cut. Further, the right end portion of the luminous intensity distribution pattern LSPC in the condensation mode of the left sub reflector 2LC is superimposed on substantially the center portion of the basic luminous intensity distribution pattern LMP of the left main reflector. As a result, the combined luminous intensity distribution pattern LGPC is obtained.

When the left sub reflector 2L is located at the position B, the left sub reflector 2LB is located between the position A and the position C as shown in FIG. 2 and FIG. 6. At this time, the intermediate luminous intensity distribution pattern LSPB as shown in FIG. 3 line (3) is obtained as the reflection light from the left sub reflector 2LB. This intermediate luminous intensity distribution pattern LSPB and the luminous intensity distribution pattern LMP (refer to FIG. 3 line (1)) obtained by the left main reflector 1L are combined together, and an intermediate combined luminous intensity distribution pattern LGPB as shown in FIG. 3 line (6) is obtained as a result.

In other words, the combined luminous intensity distribution pattern LGPB of the intermediate type between the luminous intensity distribution pattern LGPA of the spread type as shown in FIG. 3 line (5) and the combined luminous intensity distribution pattern LGPC of the condensation type as shown in FIG. 3 line (7) is obtained. Further, the intermediate luminous intensity distribution pattern LSPB and the intermediate combined luminous intensity distribution pattern LGPB change continuously between the luminous intensity distribution patterns LSPA and PGPA at the position A and the luminous intensity distribution patterns PSPC and LGPC at the position C respectively by continuously rotating the left sub reflector 2L.

In a similar manner to that of the left headlamp 3L, when the right sub reflector 2R of the right headlamp 3R is located at the position A, the right sub reflector 2RA is in the closed status as shown in FIG. 8. At this time, the luminous intensity distribution pattern RSPA of the spread mode as shown in FIG. 4 line (2) is obtained as the reflection light from the right sub reflector 2RA. The luminous intensity distribution pattern RSPA of the spread mode and the luminous intensity distribution pattern RMP (refer to FIG. 4 line (1)) obtained by the right main reflector 1R are combined together, and a combined luminous intensity distribution pattern RGPA of a spread type as shown in FIG. 4 line (5) is obtained as a result.

Figure 10:
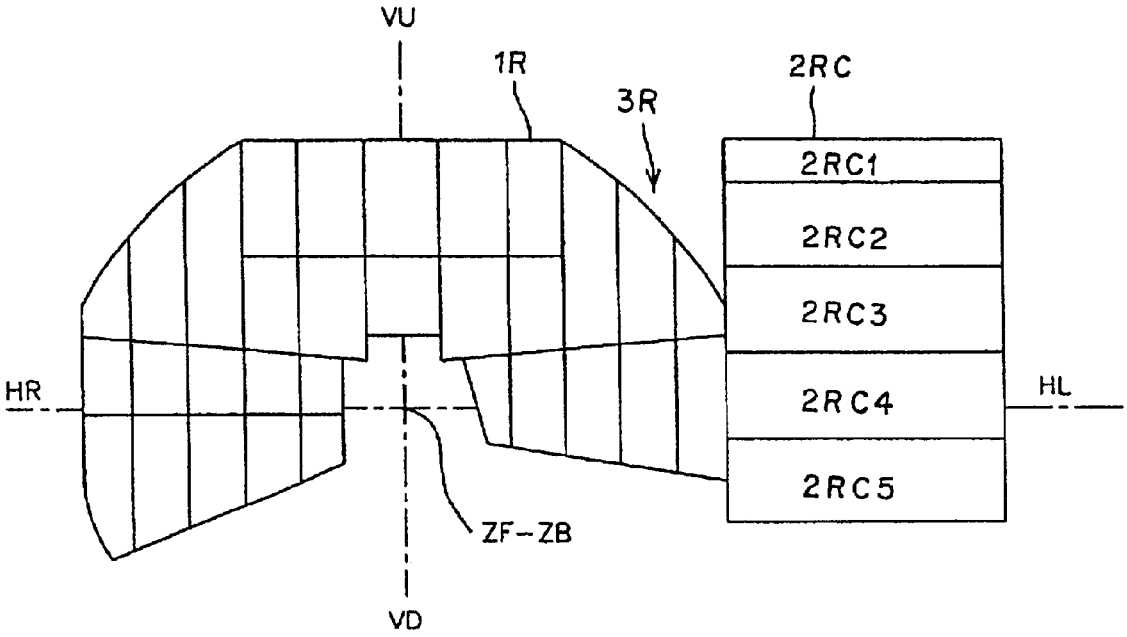
FIG. 10 is a front view of the right headlamp which shows an outline status that the sub reflector is located at the position C.

When the right sub reflector 2R is located at the position C, the right sub reflector 2RC is in the opened status as shown in FIG. 10. At this time, the luminous intensity distribution pattern RSPC of the condensation mode as shown in FIG. 4 line (4) is obtained as the reflection light from the right sub reflector 2RC. The luminous intensity distribution pattern RSPC of the condensation mode and the luminous intensity distribution pattern RMP (refer to FIG. 4 line (1)) obtained by the right main reflector 1R are combined together, and a combined luminous intensity distribution pattern RGPC of a condensation type as shown in FIG. 4 line (7) is obtained as a result.

When the right sub reflector 2R is located at the position B, the right sub reflector 2RB is located between the position A and the position C as shown in FIG. 9. At this time, the intermediate luminous intensity distribution pattern RSPB as shown in FIG. 4 line (3) is obtained as the reflection light from the right sub reflector 2RB. This intermediate luminous intensity distribution pattern RSPB and the luminous intensity distribution pattern RMP (refer to FIG. 4 line (1)) obtained by the right main reflector 1R are combined together, and an intermediate combined luminous intensity distribution pattern RGPB as shown in FIG. 4 line (6) is obtained as a result.

In other words, the combined luminous intensity distribution pattern RGPB of the intermediate type between the luminous intensity distribution pattern RGPA of the spread type as shown in FIG. 4 line (5) and the combined luminous intensity distribution pattern RGPC of the condensation type as shown in FIG. 4 line (7) is obtained. Further, the intermediate luminous intensity distribution pattern RSPB and the intermediate combined luminous intensity distribution pattern RGPB change continuously between the luminous intensity distribution patterns RSPA and RGPA at the position A and the luminous intensity distribution patterns RSPC and RGPC at the position C respectively by continuously rotating the right sub reflector 2R.

The running mode and the luminous intensity distribution pattern will be explained with reference to FIGS. 11A and 11B to FIG. 18.

Figure 11A:
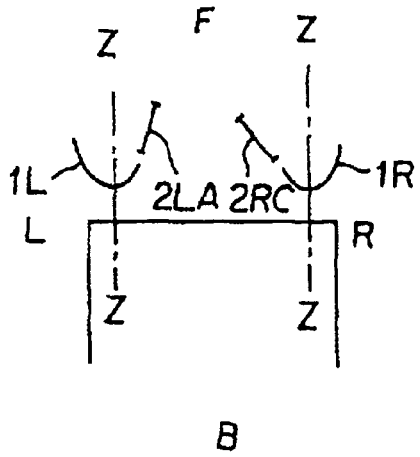
FIG. 11A is an explanatory diagram which shows a position of the sub reflector when an automobile turns a left curve.
Figure 11B:
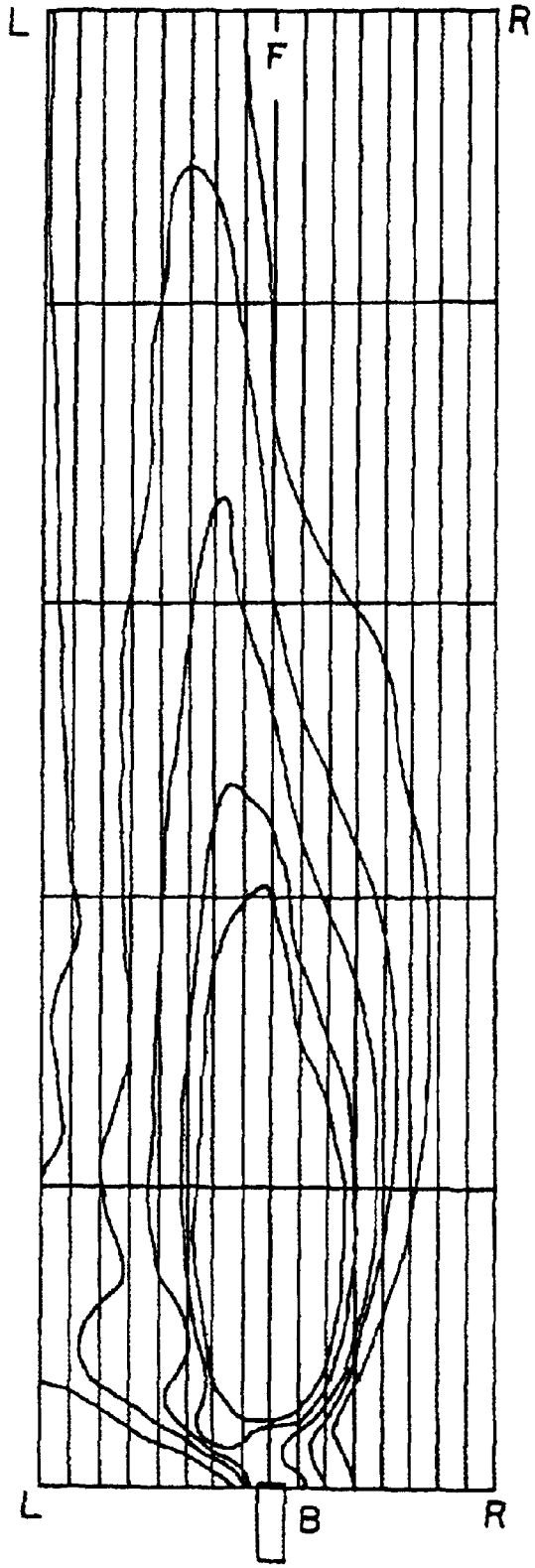
FIG. 11B is an explanatory diagram which shows a simplified luminous intensity distribution pattern when an automobile turns a left curve obtained by a computer simulation.
Figure 12:
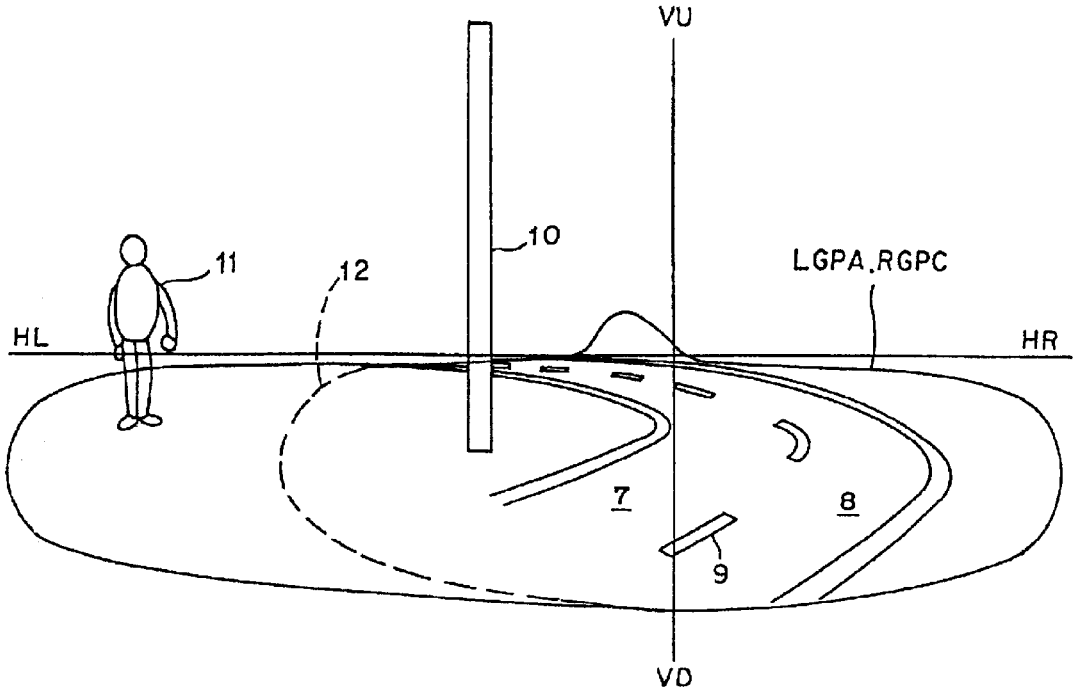
FIG. 12 is an image diagram which shows a luminous intensity distribution pattern when an automobile turns a left curve.
Figure 13A:
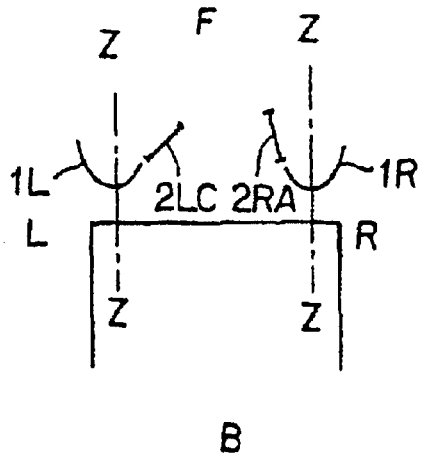
FIG. 13A is an explanatory diagram which shows a position of the sub reflector when an automobile turns a right curve
Figure 13B:
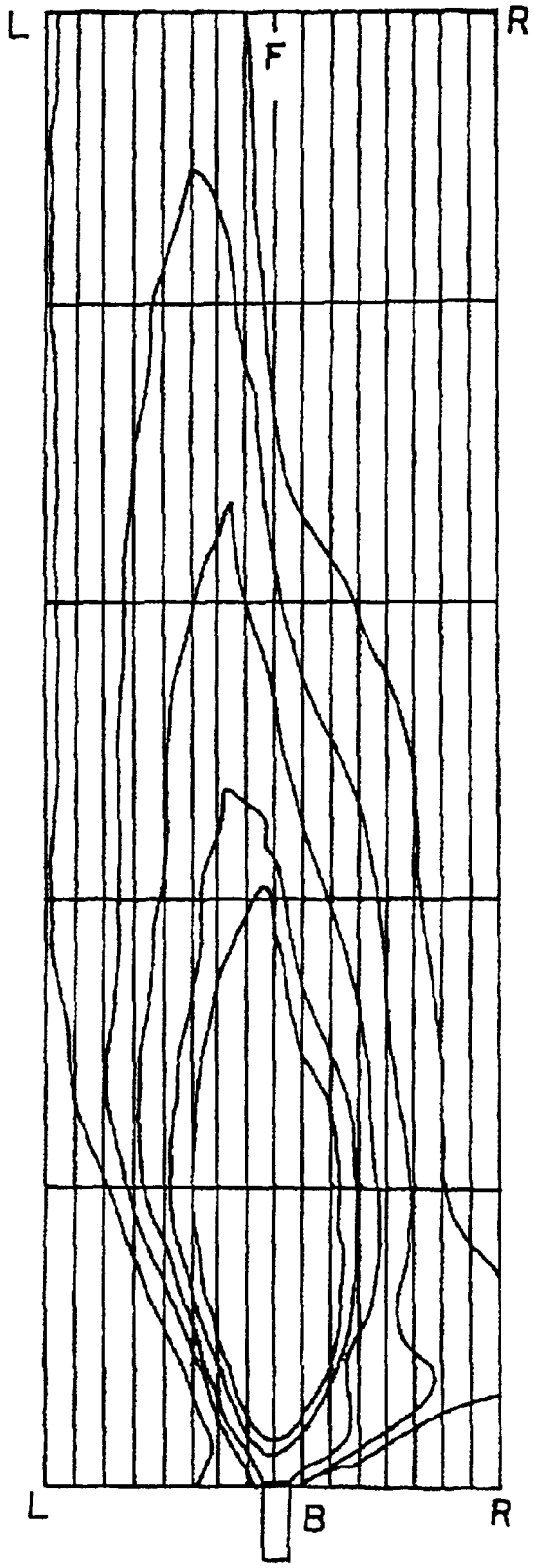
FIG. 13B is an explanatory diagram which shows a simplified luminous intensity distribution pattern when an automobile turns a right curve obtained by a computer simulation.
Figure 14:
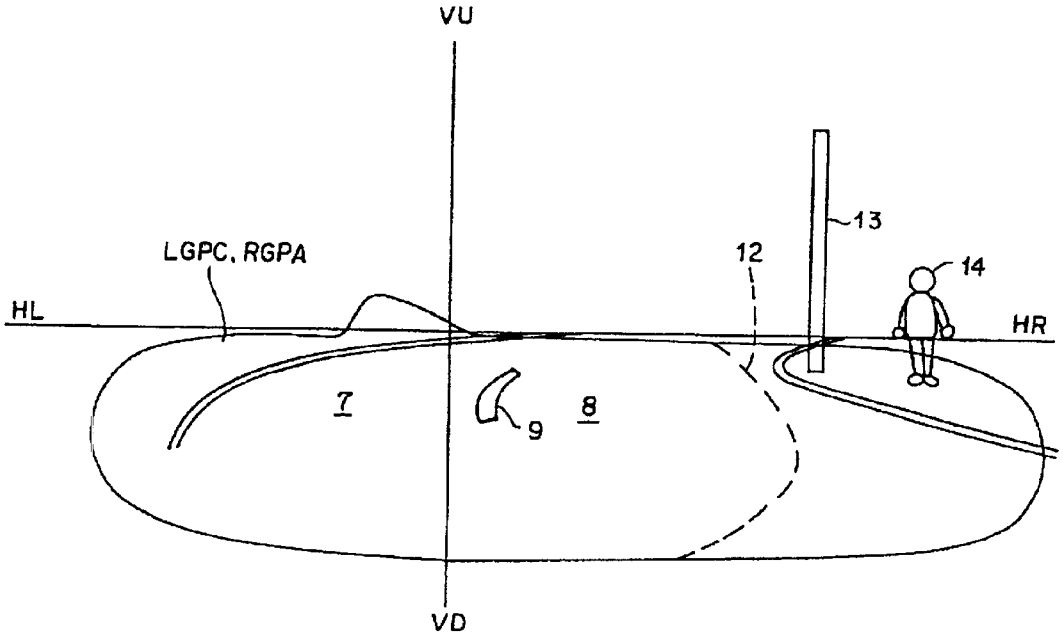
FIG. 14 is an image diagram which shows a luminous intensity distribution pattern when an automobile turns a right curve.
Figure 15A:
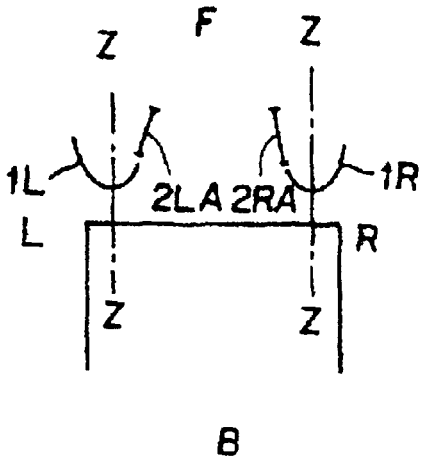
FIG. 15A is an explanatory diagram which shows a position of the sub reflector when an automobile is running on a town road (spread in left and right directions)
Figure 15B:
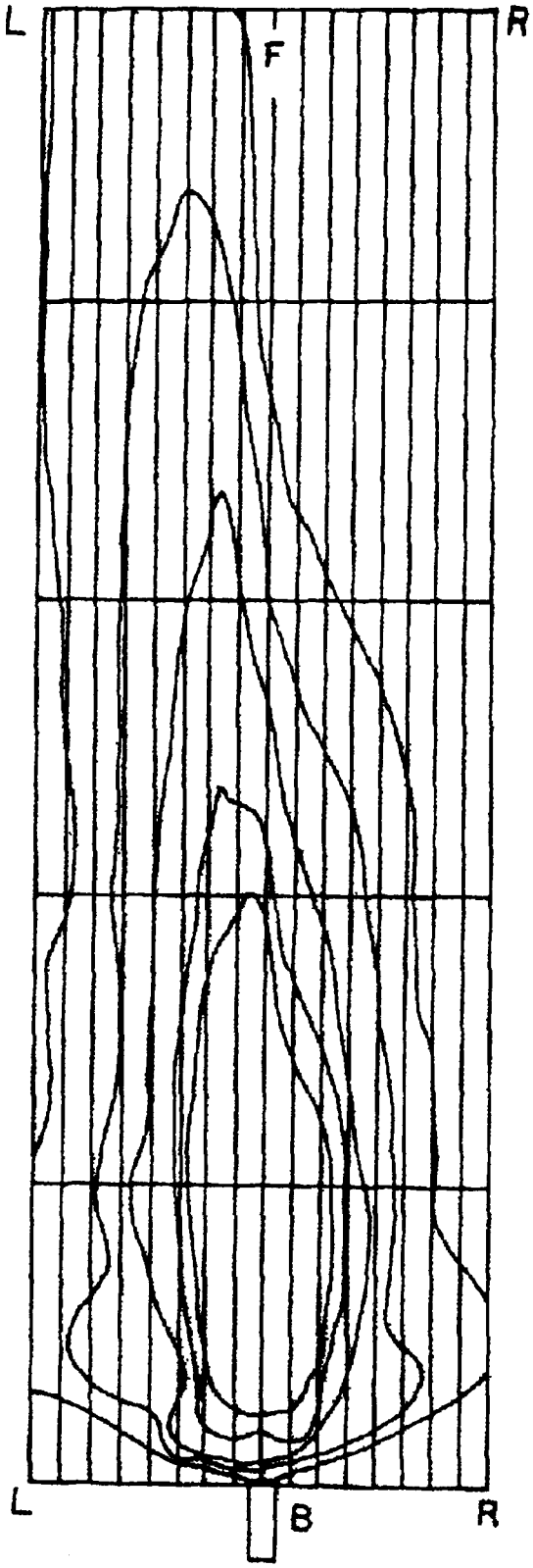
FIG. 15B is an explanatory diagram which shows a simplified luminous intensity distribution pattern when an automobile is running on a town road (spread in left and right directions) obtained by a computer simulation.
Figure 16:
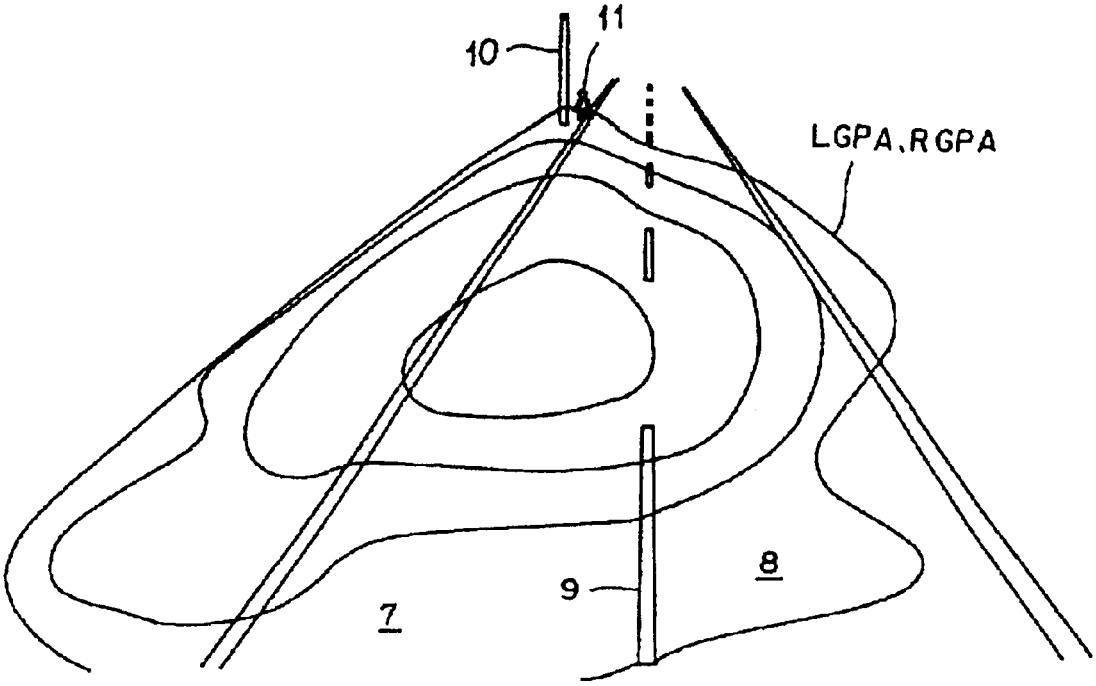
FIG. 16 is an image diagram which shows a luminous intensity distribution pattern when an automobile is running on a town road (spread in left and right directions)
Figure 17A:
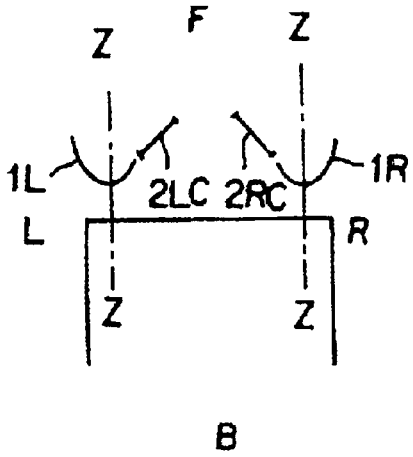
FIG. 17A is an explanatory diagram which shows a position of the sub reflector when an automobile is running at a high speed (in light condensation)
Figure 17B:
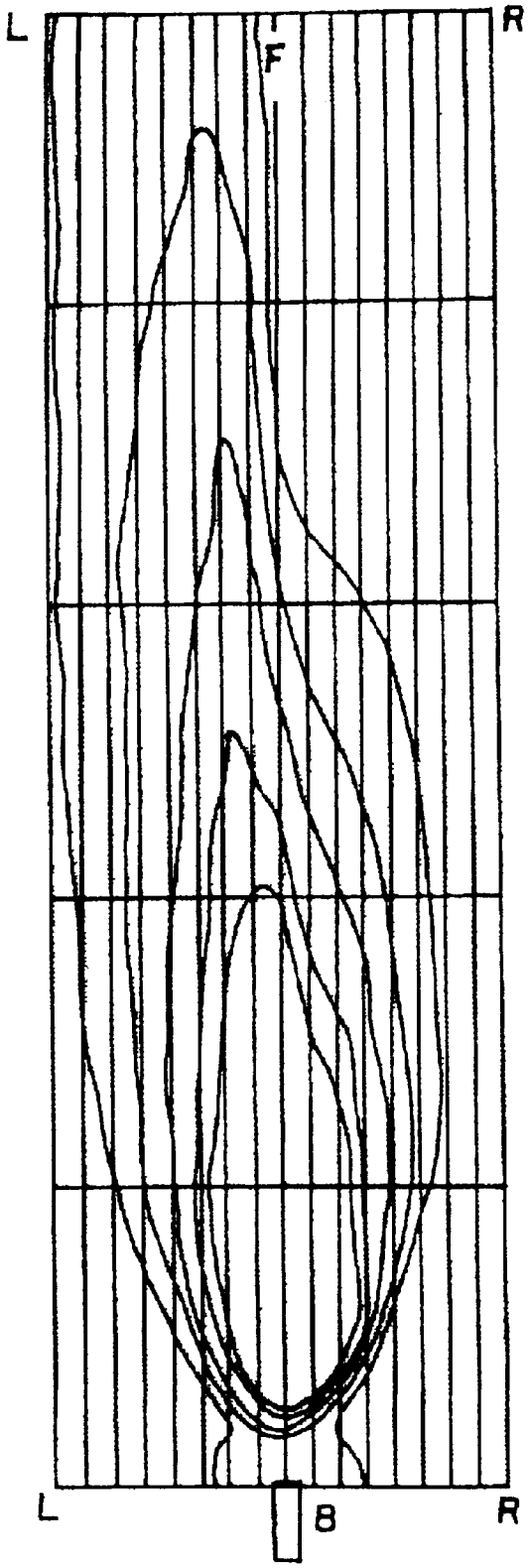
FIG. 17B is an explanatory diagram which shows a simplified luminous intensity distribution pattern when an automobile is running at a high speed (in light condensation) obtained by a computer simulation.
Figure 18:
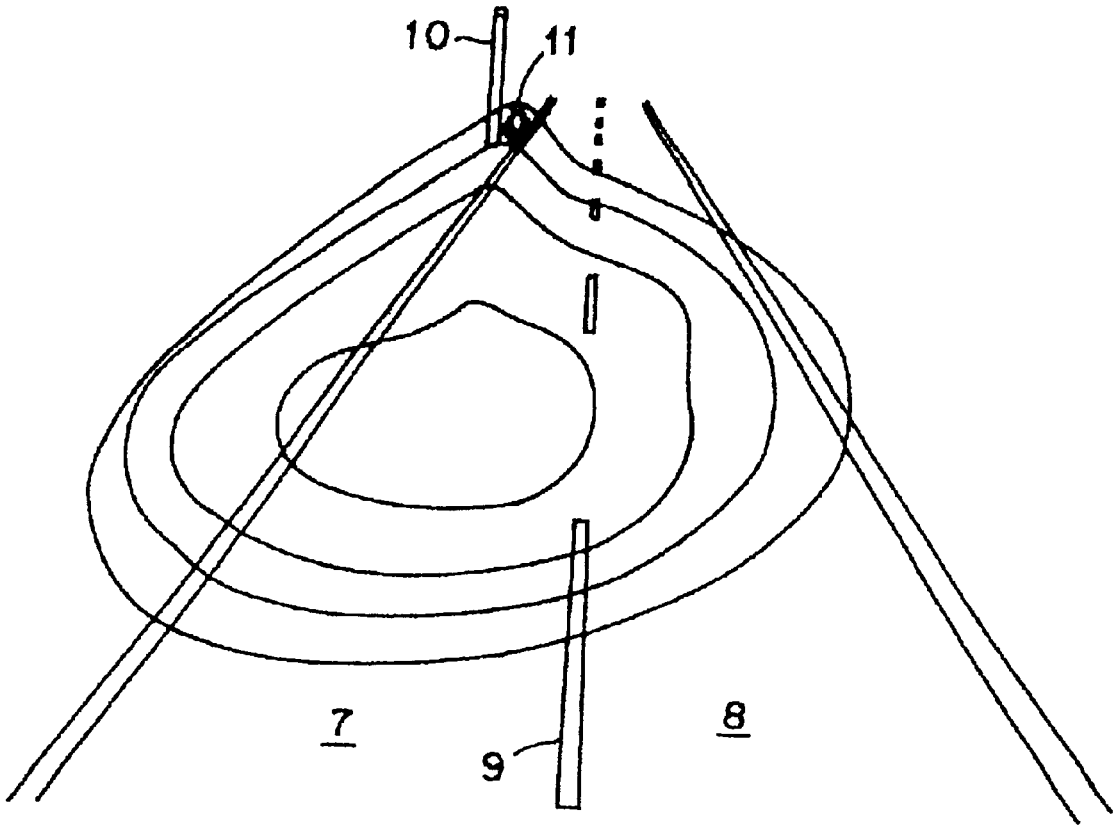
FIG. 18 is an image diagram which shows a luminous intensity distribution pattern when an automobile is running at a high speed (in light condensation)

FIG. 11A is an explanatory diagram which shows a position of the sub reflector when an automobile turns a left curve. FIG. 11B is an explanatory diagram which shows a simplified luminous intensity distribution pattern when an automobile turns a left curve obtained by a computer simulation. FIG. 12 is an image diagram which shows a luminous intensity distribution pattern when an automobile turns a left curve. FIG. 13A is an explanatory diagram which shows a position of the sub reflector when an automobile turns a right curve. FIG. 13B is an explanatory diagram which shows a simplified luminous intensity distribution pattern when an automobile turns a right curve obtained by a computer simulation. FIG. 14 is an image diagram which shows a luminous intensity distribution pattern when an automobile turns a right curve. FIG. 15A is an explanatory diagram which shows a position of the sub reflector when an automobile is running on a town road (spread in left and right directions). FIG. 15B is an explanatory diagram which shows a simplified luminous intensity distribution pattern when an automobile is running on a town road (spread in left and right directions) obtained by a computer simulation. FIG. 16 is an image diagram which shows a luminous intensity distribution pattern when an automobile is running on a town road (spread in left and right directions). FIG. 17A is an explanatory diagram which shows a position of the sub reflector when an automobile is running at a high speed (in light condensation). FIG. 17B is an explanatory diagram which shows a simplified luminous intensity distribution pattern when an automobile is running at a high speed (in light condensation) obtained by a computer simulation. FIG. 18 is an image diagram which shows a luminous intensity distribution pattern when an automobile is running at a high speed (in light condensation)

When the automobile C turns a left curve, the left sub reflector 2LA of the left headlamp 3L is located at the position A, and the right sub reflector 2RC of the right headlamp 3R is located at the position C, as shown in FIG. 11A. Then, the combined luminous intensity distribution pattern LGPA shown in FIG. 3 line (5) and the combined luminous intensity distribution pattern RGPC shown in FIG. 4 line (7) are combined together again, and a luminous intensity distribution pattern at the time of turning the left curve is obtained as shown in FIG. 11B. As a result, it is possible to illuminate over a wider range of the leftside than a range illuminated by the conventional luminous intensity distribution pattern 12 (indicated by a broken line) as shown in FIG. 12. Therefore, it is possible to clearly visually confirm a pedestrian 11 and a pole 10 on the left shoulder of the road. In FIG. 12, a reference number 7 denotes on own lane on which the automobile runs, 8 denotes an opposite lane, and 8 denotes a centerline.

When the automobile C turns a right curve, the left sub reflector 2LC of the left headlamp 3L is located at the position C, and the right sub reflector 2RA of the right headlamp 3R is located at the position A, as shown in FIG. 13A. Then, the combined luminous intensity distribution pattern LGPC shown in FIG. 3 line (7) and the combined luminous intensity distribution pattern RGPA shown in FIG. 4 line (5) are combined together again, and a luminous intensity distribution pattern at the time of turning the right curve is obtained as shown in FIG. 13B. As a result, it is possible to illuminate over a wider range of the rightside than a range illuminated by the conventional luminous intensity distribution pattern 12 (indicated by a broken line) as shown in FIG. 14. Therefore, it is possible to clearly visually confirm a pedestrian 14 and a pole 13 on the right shoulder of the road.

When the automobile C runs on a town road, the left sub reflector 2LA of the left headlamp 3L and the right sub reflector 2RA of the right headlamp 3R are located at the position A respectively, as shown in FIG. 15A. Then, the combined luminous intensity distribution pattern LGPA shown in FIG. 3 line (5) and the combined luminous intensity distribution pattern RGPA shown in FIG. 4 line (5) are combined together again. Consequently, a luminous intensity distribution pattern at the time of running on the town road, that is, the luminous intensity distribution pattern spread in the left and right directions, is obtained as shown in FIG. 15B. As a result, it is possible to illuminate over a wider range of both left and right sides. Therefore, it is possible to obtain an illumination suitable for the running on the town road.

When the automobile C runs at a high speed, the left sub reflector 2LC of the left headlamp 3L and the right sub reflector 2RC of the right headlamp 3R are located at the position C respectively, as shown in FIG. 17A. Then, the combined luminous intensity distribution pattern LGPC shown in FIG. 3 line (7) and the combined luminous intensity distribution pattern RGPC shown in FIG. 4 line (7) are combined together again. Consequently, a luminous intensity distribution pattern at the time of running at a high speed, that is, the luminous intensity distribution pattern in light condensation, is obtained as shown in FIG. 17B. As a result, it is possible to illuminate the far front side as shown in FIG. 18. The driver can concentrate the view confirmation on the far side. Therefore, it is possible to obtain an illumination suitable for the running at a high speed.

The luminous intensity distribution pattern of each segment of the sub reflector will be explained with reference to FIG. 19 to FIG. 38.

FIG. 19 to FIG. 38 are explanatory diagrams each which shows a simplified luminous intensity distribution pattern of a segment (a luminous intensity distribution pattern having a concentration of a small square light source image) obtained by a computer simulation.

Figure 19:
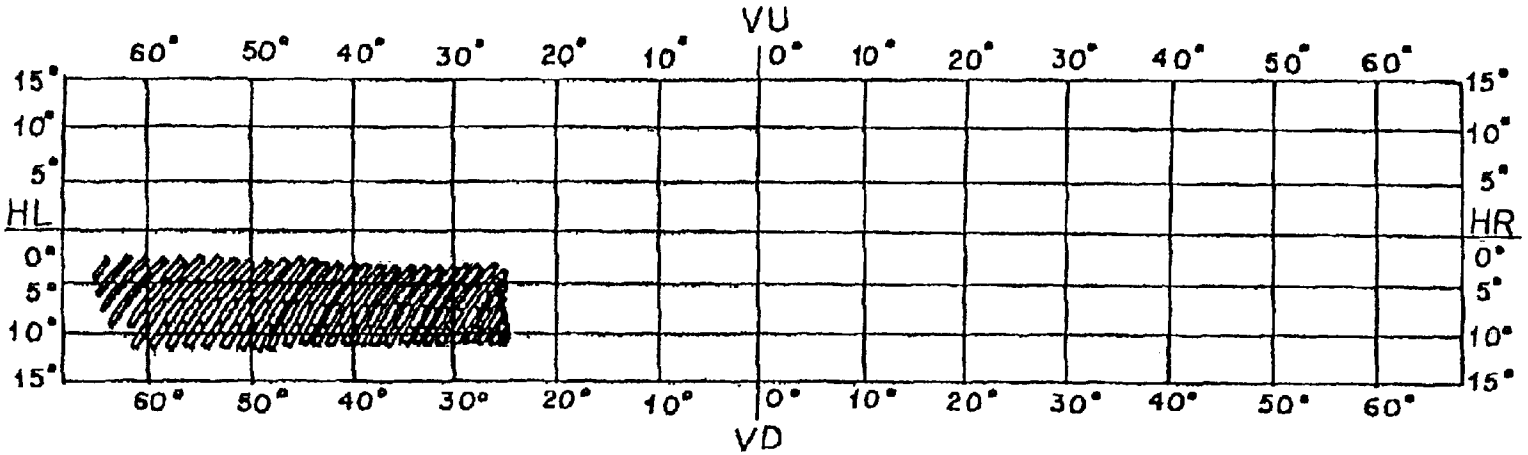
FIG. 19 is an explanatory diagram which shows a simplified luminous intensity distribution pattern of a first segment when the sub reflector of the left headlamp is located at the position A, which is a luminous intensity distribution pattern obtained by a computer simulation.

FIG. 19 shows a luminous intensity distribution pattern of a first segment 2LA1 (refer to FIG. 5) when the left sub reflector 2LA of the left headlamp 3L is located at the position A. This first segment 2LA1 is located at a highest position. Therefore, when this segment illuminates an area below the left-and-right horizontal line HL-HR, there is no obstacle (such as a structure of the headlamp, a structure of the automobile C, for example). Consequently, the first segment 2LA1 can spread the luminous intensity distribution pattern wide in up and down directions. Further, the first segment 2LA1 can allocate the luminous intensity distribution pattern large to the leftside. Further, the first segment 2LA1 can direct the luminous intensity distribution pattern large downward. The range of the luminous intensity distribution pattern of the first segment 2LA1 when located at the position A is from about 24 degrees in the left to about 65 degrees in the left, and from about 2.5 degrees down to about 11.5 degrees down.

Figure 20:
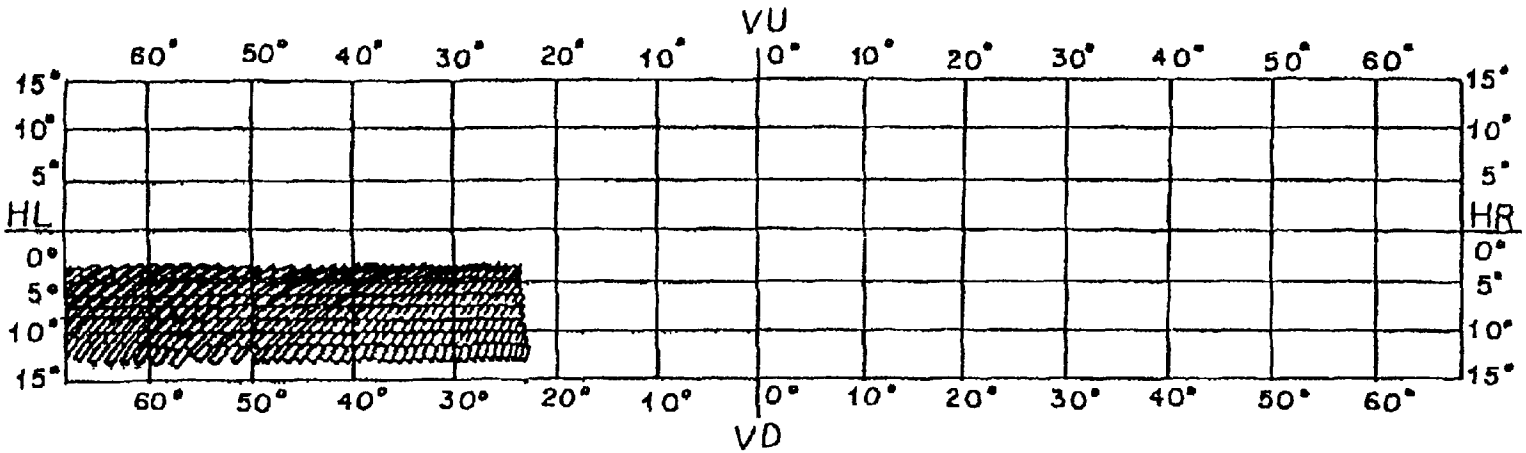
FIG. 20 is an explanatory diagram which shows a simplified luminous intensity distribution pattern of a second segment when the sub reflector of the left headlamp is located at the position A, which is a luminous intensity distribution pattern obtained by a computer simulation.

FIG. 20 shows a luminous intensity distribution pattern of a second segment 2LA2 (refer to FIG. 5) when the left sub reflector 2LA of the left headlamp 3L is located at the position A. This second segment 2LA2 is located at a second highest position. Therefore, when this segment illuminates an area below the left-and-right horizontal line HL-HR, there is no obstacle. Further, the light quantity from the light source 4 is large. Consequently, the second segment 2LA2 can spread the luminous intensity distribution pattern wide in up and down directions. Further, the second segment 2LA2 can allocate the luminous intensity distribution pattern large to the leftside. Further, the second segment 2LA2 can direct the luminous intensity distribution pattern downward. The range of the luminous intensity distribution pattern of the second segment 2LA2 when located at the position A is from about 23 degrees in the left to about 70 degrees in the left, and from about 3 degrees down to about 13 degrees down.

Figure 21:
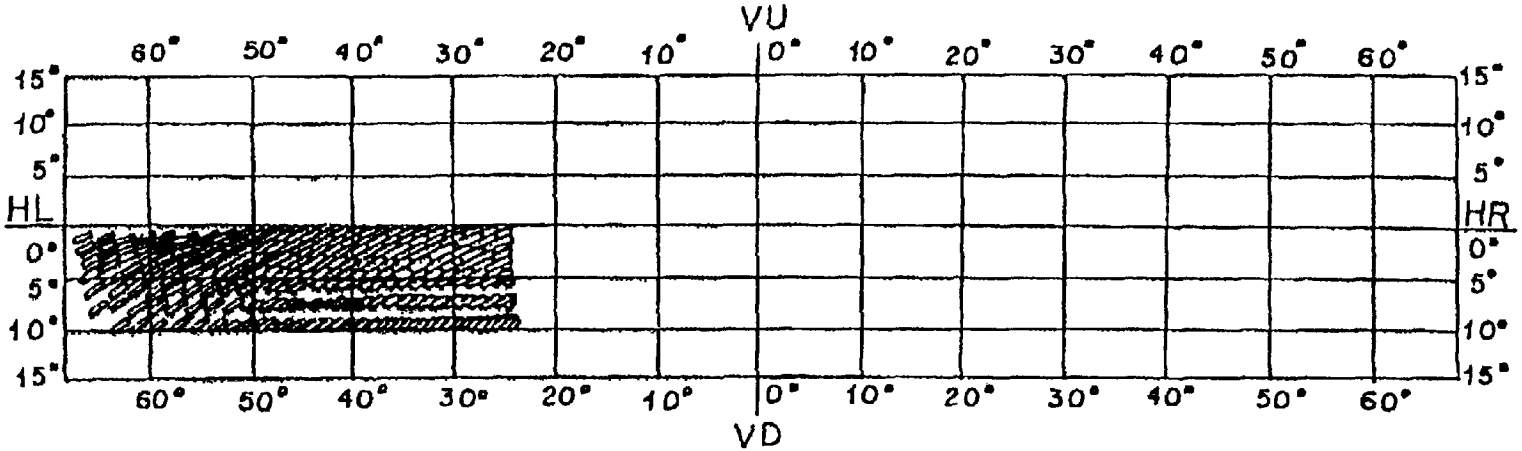
FIG. 21 is an explanatory diagram which shows a simplified luminous intensity distribution pattern of a third segment when the sub reflector of the left headlamp is located at the position A, which is a luminous intensity distribution pattern obtained by a computer simulation.

FIG. 21 shows a luminous intensity distribution pattern of a third segment 2LA3 (refer to FIG. 5) when the left sub reflector 2LA of the left headlamp 3L is located at the position A. This third segment 2LA3 is located at a third highest position. Therefore, when this segment illuminates an area below the left-and-right horizontal line HL-HR, there is no obstacle. Further, the light quantity from the light source 4 is largest. Consequently, the third segment 2LA3 can spread the luminous intensity distribution pattern wide in up and down directions. Further, the third segment 2LA3 can allocate the luminous intensity distribution pattern large to the leftside. Further, the third segment 2LA3 can bring the luminous intensity distribution pattern close to the left-and-right horizontal line HL-HR. The range of the luminous intensity distribution pattern of the third segment 2LA3 when located at the position A is from about 23.5 degrees in the left to about 67 degrees in the left, and from about 0 degree to about 10 degrees down.

Figure 22:
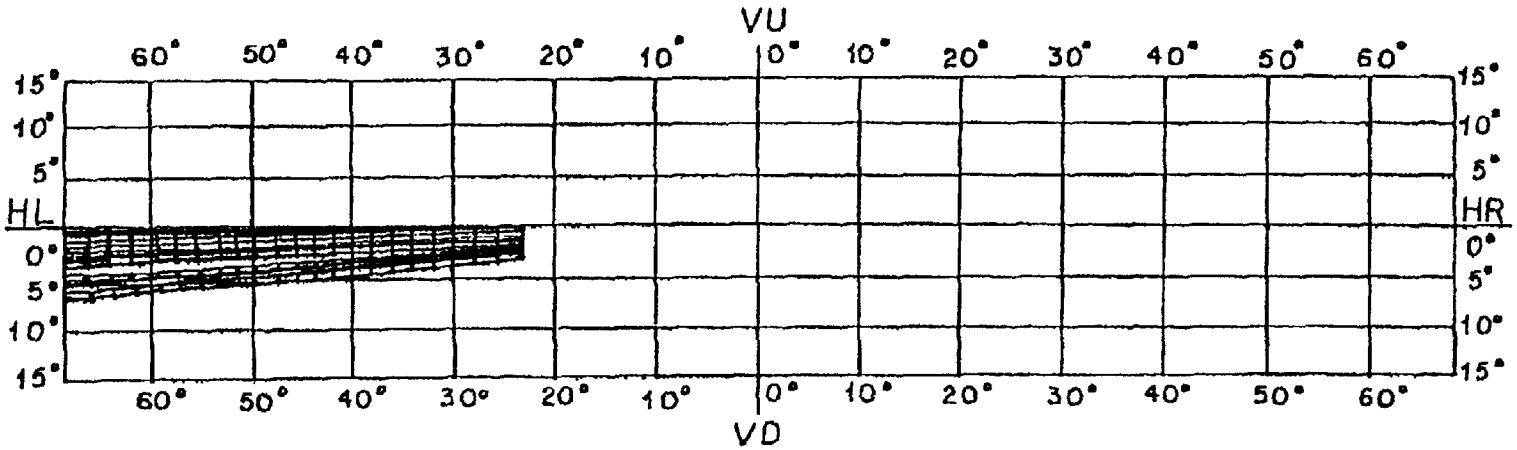
FIG. 22 is an explanatory diagram which shows a simplified luminous intensity distribution pattern of a fourth segment when the sub reflector of the left headlamp is located at the position A, which is a luminous intensity distribution pattern obtained by a computer simulation.

FIG. 22 shows a luminous intensity distribution pattern of a fourth segment 2LA4 (refer to FIG. 5) when the left sub reflector 2LA of the left headlamp 3L is located at the position A. This fourth segment 2LA4 is located at a fourth highest position. Therefore, when this segment illuminates an area below the left-and-right horizontal line HL-HR, there is an obstacle. Further, the light quantity from the light source 4 is large. Consequently, the fourth segment 2LA4 needs to narrow the luminous intensity distribution pattern in up and down directions. Further, the fourth segment 2LA4 can allocate the luminous intensity distribution pattern large to the leftside. Further, the fourth segment 2LA4 can bring the luminous intensity distribution pattern close to the left-and-right horizontal line HL-HR. The range of the luminous intensity distribution pattern of the fourth segment 2LA4 when located at the position A is from about 23 degrees in the left to about 70 degrees in the left, and from about 0 degree to about 5 degrees down (about 3.5 degrees down to about 6.5 degrees down).

Figure 23:
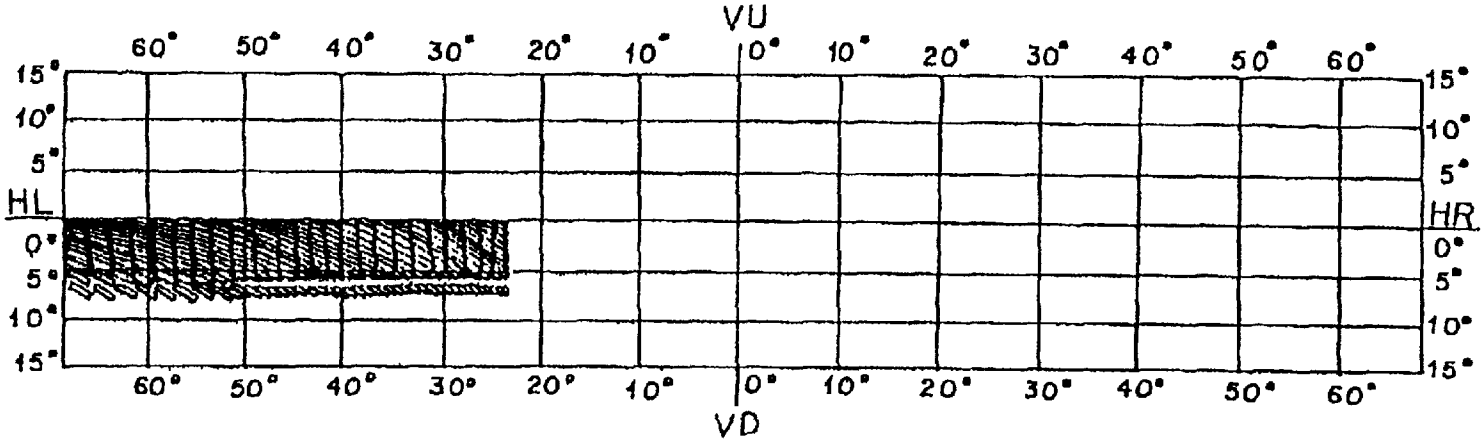
FIG. 23 is an explanatory diagram which shows a simplified luminous intensity distribution pattern of a fifth segment when the sub reflector of the left headlamp is located at the position A, which is a luminous intensity distribution pattern obtained by a computer simulation.

FIG. 23 shows a luminous intensity distribution pattern of a fifth segment 2LA5 (refer to FIG. 5) when the left sub reflector 2LA of the left headlamp 3L is located at the position A. This fifth segment 2LA5 is located at a fifth position from the above (that is, a lowest position). Therefore, when this segment illuminates an area below the left-and-right horizontal line HL-HR, there is an obstacle. Consequently, the fifth segment 2LA5 needs to slightly narrow the luminous intensity distribution pattern in up and down directions. Further, the fifth segment 2LA5 can allocate the luminous intensity distribution pattern large to the leftside. Further, the fifth segment 2LA5 can bring the luminous intensity distribution pattern close to the left-and-right horizontal line HL-HR. The range of the luminous intensity distribution pattern of the fifth segment 2LA5 when located at the position A is from about 23 degrees in the left to about 70 degrees in the left, and from about 0 degree to about 7.5 degrees down.

By combining the luminous intensity distribution patterns shown in FIG. 19 to FIG. 23 together, an auxiliary luminous intensity distribution pattern of a spread type is formed when the left sub reflector 2LA of the left headlamp 3L (the sub reflector of the headlamp installed at the opposite side of the driving seat of the automobile) is located at the position A (the first position). The auxiliary luminous intensity distribution pattern of the spread type is spread to the left and right directions (from about 23 degrees in the left to about 70 degrees in the left) at the left side of the up-and-down vertical line VU-VD (at the opposite side of the driving seat). This auxiliary luminous intensity distribution pattern is also spread to the up and down directions (from about 0 degree to about 70 degrees down) at a lower side of the left-and-right horizontal line HL-HR. Particularly, the luminous intensity distribution patterns are superimposed, and the illumination is bright, over a range from about 3 degrees down to about 6.5 degrees down. This is because the light is controlled from being wasted by the hood. In other words, when the opposite side of the driving seat is looked at from the eye point of the driver, the hood of the automobile is visible at a lower side (about 13 degrees down) of the opposite side of the driving seat. Even when light is irradiated to the lower side (about 13 degrees down) of the hood, this light becomes wasteful. Therefore, by illuminating the area above the hood, it is possible to effectively utilize the light.

Figure 24:
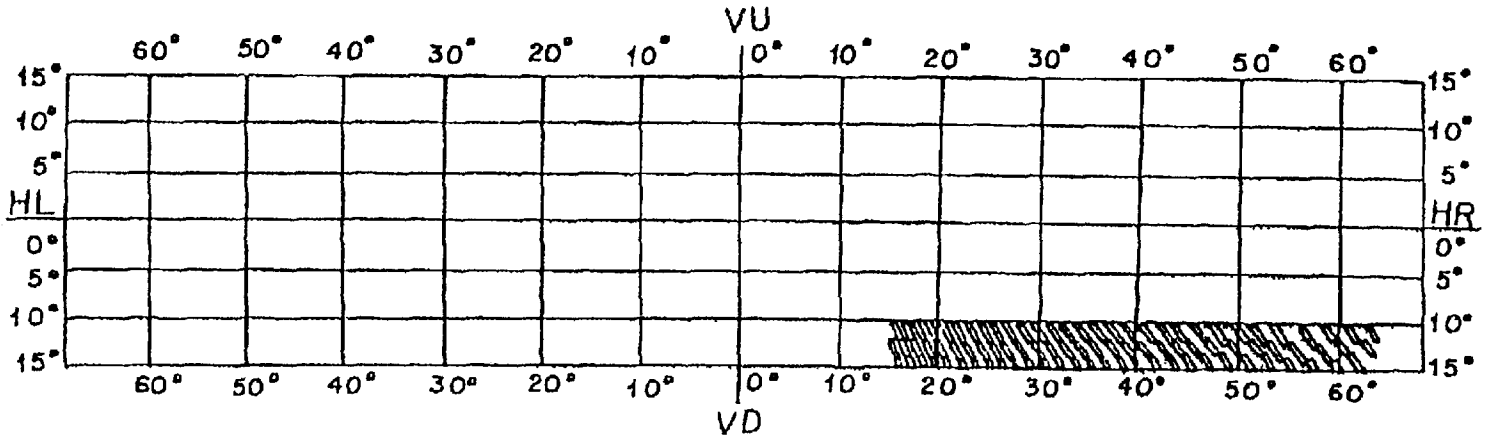
FIG. 24 is an explanatory diagram which shows a simplified luminous intensity distribution pattern of a first segment when the sub reflector of the right headlamp is located at the position A, which is a luminous intensity distribution pattern obtained by a computer simulation.

FIG. 24 shows a luminous intensity distribution pattern of a first segment 2RA1 (refer to FIG. 8) when the right sub reflector 2RA of the right headlamp 3R is located at the position A. This first segment 2RA1 is located at a highest position. Therefore, when this segment illuminates an area below the left-and-right horizontal line HL-HR, there is no obstacle. Consequently, the first segment 2RA1 can spread the luminous intensity distribution pattern wide in up and down directions. Further, the first segment 2RA1 can allocate the luminous intensity distribution pattern large to the rightside. Further, the first segment 2RA1 can direct the luminous intensity distribution pattern large downward. The range of the luminous intensity distribution pattern of the first segment 2RA1 when located at the position A is from about 15 degrees in the right to about 635 degrees in the right, and from about 10 degrees down to about 15 degrees down.

Figure 25:
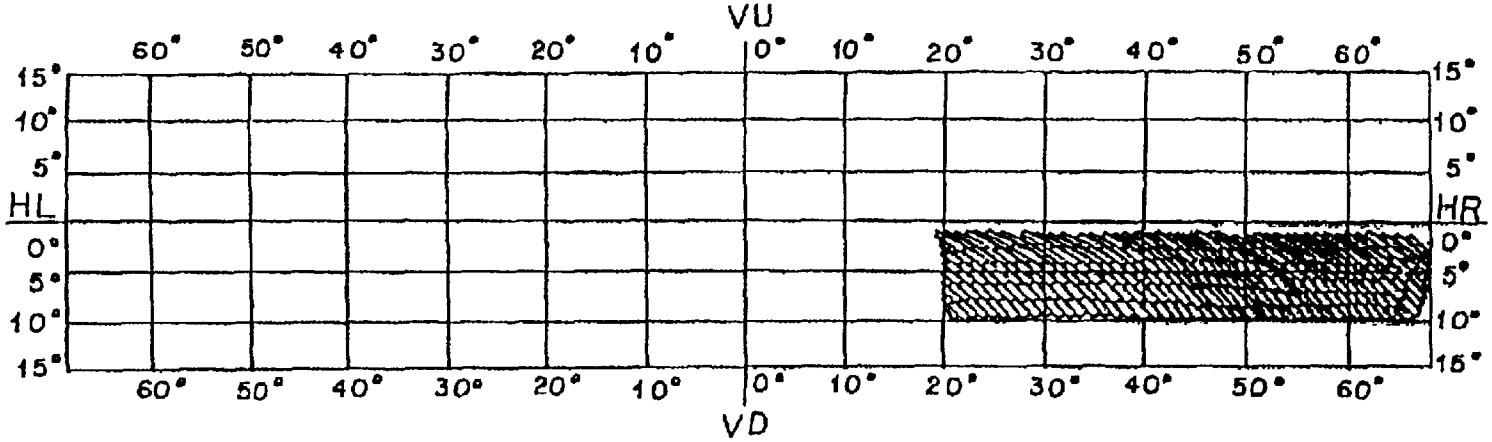
FIG. 25 is an explanatory diagram which shows a simplified luminous intensity distribution pattern of a second segment when the sub reflector of the right headlamp is located at the position A, which is a luminous intensity distribution pattern obtained by a computer simulation.

FIG. 25 shows a luminous intensity distribution pattern of a second segment 2RA2 (refer to FIG. 8) when the right sub reflector 2RA of the right headlamp 3R is located at the position A. This second segment 2LA2 is located at a second highest position. Therefore, when this segment illuminates an area below the left-and-right horizontal line HL-HR, there is no obstacle. Further, the light quantity from the light source 4 is large. Consequently, the second segment 2RA2 can spread the luminous intensity distribution pattern wide in up and down directions. Further, the second segment 2RA2 can allocate the luminous intensity distribution pattern large to the rightside. Further, the second segment 2RA2 can bring the luminous intensity distribution pattern to the vicinity of the left-and-right horizontal line HL-HR. The range of the luminous intensity distribution pattern of the second segment 2RA2 when located at the position A is from about 20 degrees in the right to about 67.5 degrees in the right, and from about 1.5 degrees down to about 10 degrees down.

Figure 26:
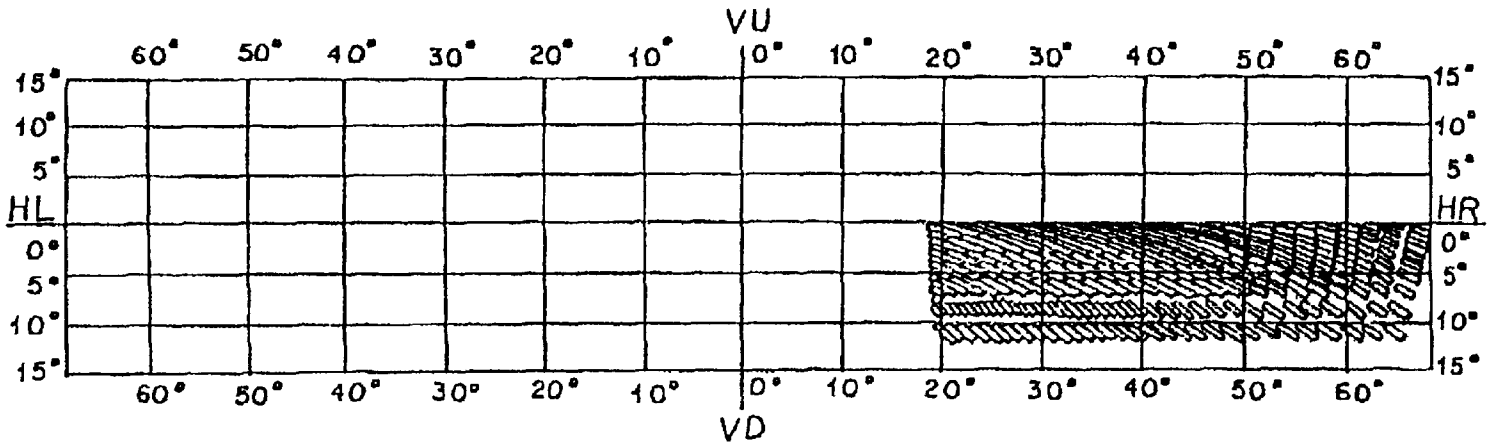
FIG. 26 is an explanatory diagram which shows a simplified luminous intensity distribution pattern of a third segment when the sub reflector of the right headlamp is located at the position A, which is a luminous intensity distribution pattern obtained by a computer simulation.

FIG. 26 shows a luminous intensity distribution pattern of a third segment 2RA3 (refer to FIG. 8) when the right sub reflector 2RA of the right headlamp 3R is located at the position A. This third segment 2RA3 is located at a third highest position. Therefore, when this segment illuminates an area below the left-and-right horizontal line HL-HR, there is no obstacle. Further, the light quantity from the light source 4 is largest. Consequently, the third segment 2RA3 can spread the luminous intensity distribution pattern wide in up and down directions. Further, the third segment 2RA3 can allocate the luminous intensity distribution pattern large to the rightside. Further, the third segment 2RA3 can bring the luminous intensity distribution pattern close to the left-and-right horizontal line HL-HR. The range of the luminous intensity distribution pattern of the third segment 2RA3 when located at the position A is from about 18.5 degrees in the right to about 67.5 degrees in the right, and from about 0 degree to about 12 degrees down.

Figure 27:
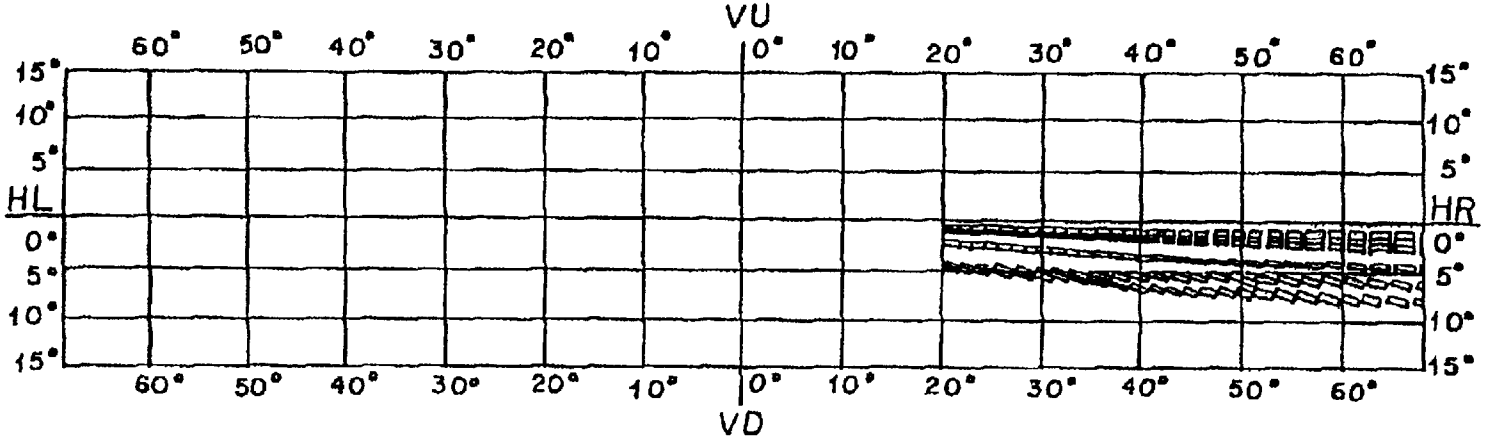
FIG. 27 is an explanatory diagram which shows a simplified luminous intensity distribution pattern of a fourth segment when the sub reflector of the right headlamp is located at the position A, which is a luminous intensity distribution pattern obtained by a computer simulation.

FIG. 27 shows a luminous intensity distribution pattern of a fourth segment 2RA4 (refer to FIG. 8) when the right sub reflector 2RA of the right headlamp 3R is located at the position A. This fourth segment 2RA4 is located at a fourth highest position. Therefore, when this segment illuminates an area below the left-and-right horizontal line HL-HR, there is an obstacle. Further, the light quantity from the light source 4 is large. Consequently, the fourth segment 2RA4 needs to narrow the luminous intensity distribution pattern in up and down directions. Further, the fourth segment 2RA4 can allocate the luminous intensity distribution pattern large to the rightside. Further, the fourth segment 2RA4 can bring the luminous intensity distribution pattern close to the left-and-right horizontal line HL-HR. The range of the luminous intensity distribution pattern of the fourth segment 2RA4 when located at the position A is from about 20 degrees in the right to about 70 degrees in the right, and from about 1 degree down to about 6.5 degrees down (about 5 degrees down to about 8 degrees down).

Figure 28:
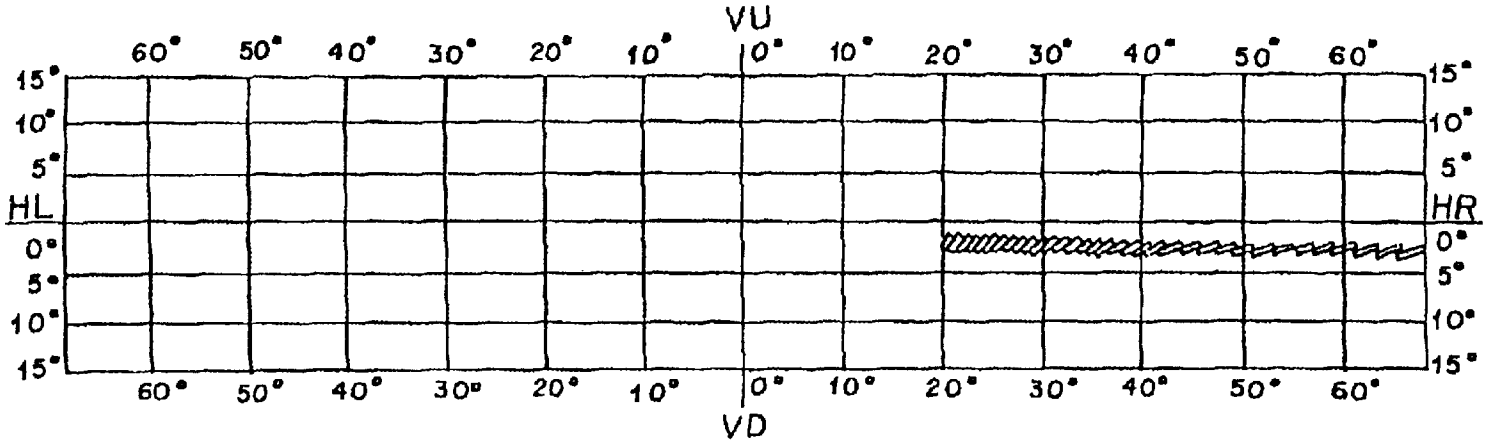
FIG. 28 is an explanatory diagram which shows a simplified luminous intensity distribution pattern of a fifth segment when the sub reflector of the right headlamp is located at the position A, which is a luminous intensity distribution pattern obtained by a computer simulation.

FIG. 28 shows a luminous intensity distribution pattern of a fifth segment 2RA5 (refer to FIG. 8) when the right sub reflector 2RA of the right headlamp 3R is located at the position A. This fifth segment 2RA5 is located at a fifth position from the above (that is, a lowest position). Therefore, when this segment illuminates an area below the left-and-right horizontal line HL-HR, there is an obstacle. Consequently, the fifth segment 2RA5 needs to extremely narrow the luminous intensity distribution pattern in up and down directions. Further, the fifth segment 2RA5 can allocate the luminous intensity distribution pattern large to the rightside. Further, the fifth segment 2RA5 can bring the luminous intensity distribution pattern close to the left-and-right horizontal line HL-HR. The range of the luminous intensity distribution pattern of the fifth segment 2RA5 when located at the position A is from about 20 degrees in the right to about 70 degrees in the right, and from about 1 degree down to about 3 degrees down.

By combining the luminous intensity distribution patterns shown in FIG. 24 to FIG. 28 together, an auxiliary luminous intensity distribution pattern of a spread type is formed when the right sub reflector 2RA of the right headlamp 3R (the sub reflector of the headlamp installed at the driving seat side of the automobile) is located at the position A (the first position). The auxiliary luminous intensity distribution pattern of the spread type is spread wide to the left and right directions (from about 15 degrees in the right to about 70 degrees in the right) at the right side of the up-and-down vertical line VU-VD (at the driving seat side) This auxiliary luminous intensity distribution pattern is also spread wide to the up and down directions (from about 0 degree to about 15 degrees down) at a lower side of the left-and-right horizontal line HL-HR. Particularly, light is irradiated over a range of about 15 degrees below. This is because the light is controlled to positively illuminate the lower side of the driving seat where there is no obstacle that interrupts the light. In other words, when the driving seat side is looked at from the eye point of the driver, there is no obstacle that interrupts the light over the range below the driving seat (about 15 degrees down). Therefore, by positively illuminating the area at the lower side of the driving seat (about 15 degrees down), the visibility of the lower side of the driving seat is improved, and it is possible to effectively utilize the light.

Figure 29:
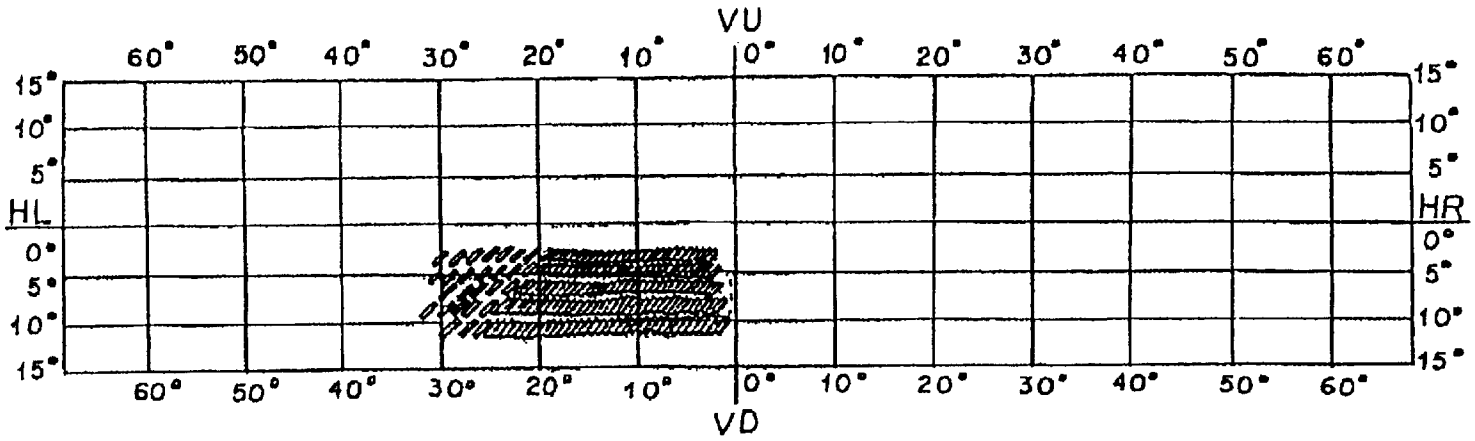
FIG. 29 is an explanatory diagram which shows a simplified luminous intensity distribution pattern of a first segment when the sub reflector of the left headlamp is located at the position C, which is a luminous intensity distribution pattern obtained by a computer simulation.

FIG. 29 shows a luminous intensity distribution pattern of a first segment 2LC1 (refer to FIG. 7) when the left sub reflector 2LC of the left headlamp 3L is located at the position C. This first segment 2LC1 is located at a highest position. Therefore, when this segment illuminates an area below the left-and-right horizontal line HL-HR, there is no obstacle. Consequently, the first segment 2LC1 can spread the luminous intensity distribution pattern wide in up and down directions. Further, the first segment 2LC1 can bring the luminous intensity distribution pattern close to the up-and-down vertical line VU-VD. Further, the first segment 2LC1 can direct the luminous intensity distribution pattern downward. The range of the luminous intensity distribution pattern of the first segment 2LC1 when located at the position C is from about 1.5 degrees in the left to about 31.5 degrees in the left, and from about 2.5 degrees down to about 11.5 degrees down.

Figure 30:
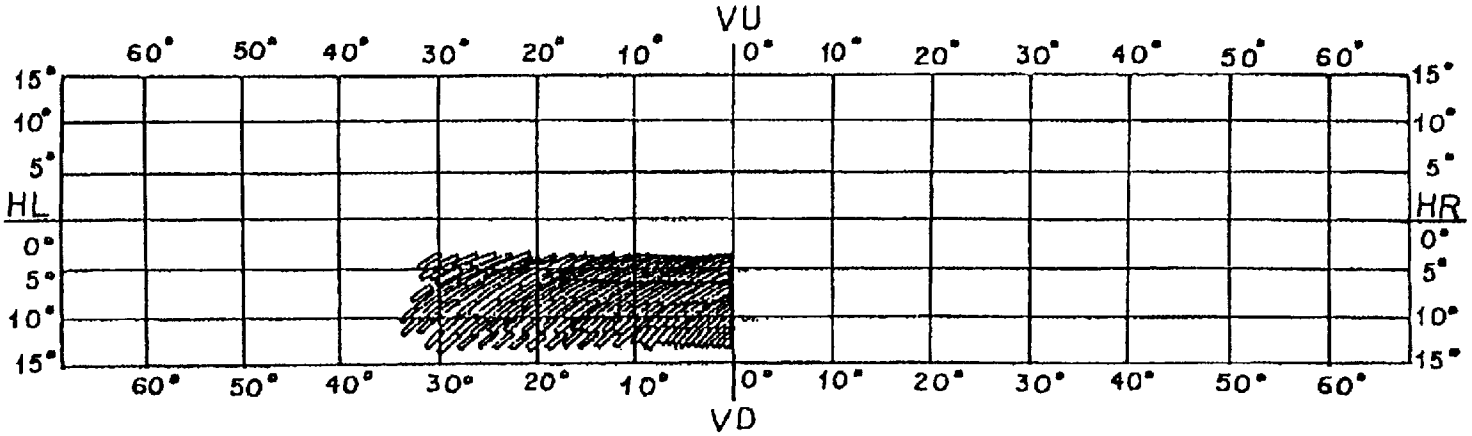
FIG. 30 is an explanatory diagram which shows a simplified luminous intensity distribution pattern of a second segment when the sub reflector of the left headlamp is located at the position C, which is a luminous intensity distribution pattern obtained by a computer simulation.

FIG. 30 shows a luminous intensity distribution pattern of a second segment 2LC2 (refer to FIG. 7) when the left sub reflector 2LC of the left headlamp 3L is located at the position C. This second segment 2LC2 is located at a second highest position. Therefore, when this segment illuminates an area below the left-and-right horizontal line HL-HR, there is no obstacle. Further, the light quantity from the light source 4 is large. Consequently, the second segment 2LC2 can spread the luminous intensity distribution pattern wide in up and down directions. Further, the second segment 2LC2 can bring the luminous intensity distribution pattern close to the up-and-down vertical line VU-VD. Further, the second segment 2LC2 can direct the luminous intensity distribution pattern downward. The range of the luminous intensity distribution pattern of the second segment 2LC2 when located at the position C is from about 0 degree in the left to about 3.5 degrees in the left, and from about 3.5 degrees down to about 13 degrees down.

Figure 31:
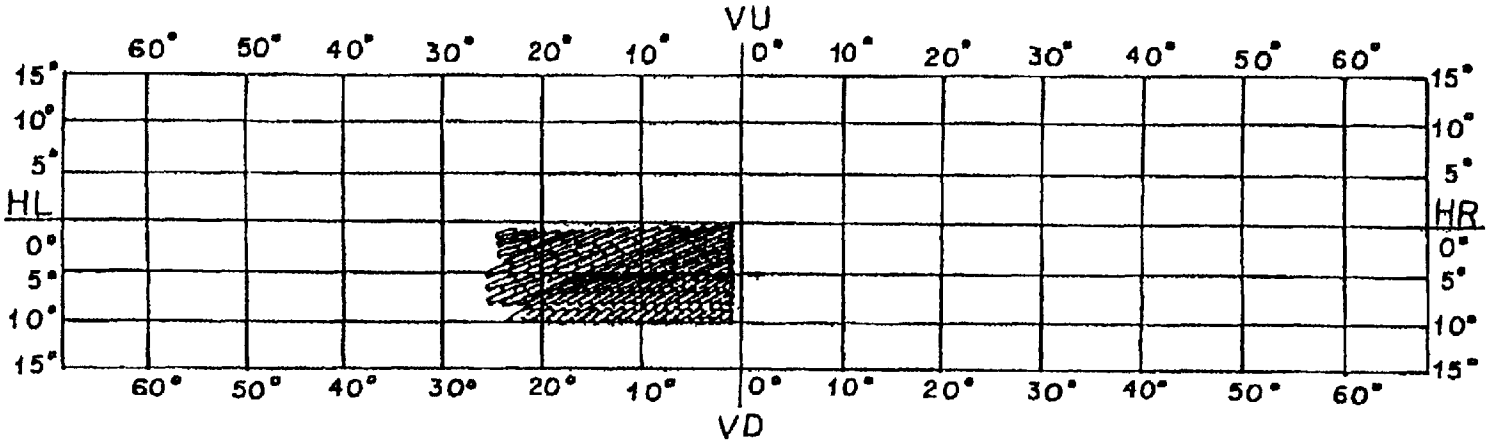
FIG. 31 is an explanatory diagram which shows a simplified luminous intensity distribution pattern of a third segment when the sub reflector of the left headlamp is located at the position C, which is a luminous intensity distribution pattern obtained by a computer simulation.

FIG. 31 shows a luminous intensity distribution pattern of a third segment 2LC3 (refer to FIG. 7) when the left sub reflector 2LC of the left headlamp 3L is located at the position C. This third segment 2LC3 is located at a third highest position. Therefore, when this segment illuminates an area below the left-and-right horizontal line HL-HR, there is no obstacle. Further, the light quantity from the light source 4 is largest. Consequently, the third segment 2LC3 can spread the luminous intensity distribution pattern in up and down directions. Further, the third segment 2LC3 can condense the luminous intensity distribution patterns in left and right directions. Further, the third segment 2LC3 can bring the luminous intensity distribution pattern close to the up-and-down vertical line VU-VD. Further, the third segment 2LC3 can bring the luminous intensity distribution pattern close to the left-and-right horizontal line HL-HR. The range of the luminous intensity distribution pattern of the third segment 2LC3 when located at the position C is from about 1 degree in the left to about 24.5 degrees in the left, and from about 1 degree down to about 10 degrees down.

Figure 32:
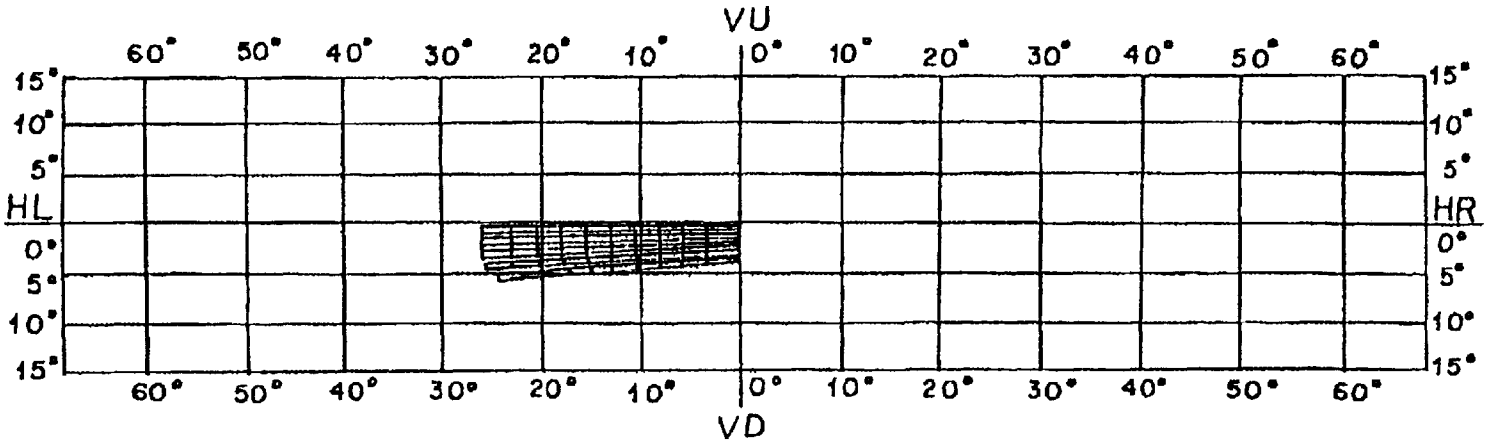
FIG. 32 is an explanatory diagram which shows a simplified luminous intensity distribution pattern of a fourth segment when the sub reflector of the left headlamp is located at the position C, which is a luminous intensity distribution pattern obtained by a computer simulation.

FIG. 32 shows a luminous intensity distribution pattern of a fourth segment 2LC4 (refer to FIG. 7) when the left sub reflector 2LC of the left headlamp 3L is located at the position C. This fourth segment 2LC4 is located at a fourth highest position. Therefore, when this segment illuminates an area below the left-and-right horizontal line HL-HR, there is an obstacle. Further, the light quantity from the light source 4 is large. Consequently, the fourth segment 2LC4 needs to narrow the luminous intensity distribution pattern in up and down directions. Further, the fourth segment 2LC4 can condense the luminous intensity distribution patterns in left and right directions. Further, the fourth segment 2LC4 can bring the luminous intensity distribution pattern close to the up-and-down vertical line VU-VD. Further, the fourth segment 2LC4 can bring the luminous intensity distribution pattern close to the left-and-right horizontal line HL-HR. The range of the luminous intensity distribution pattern of the fourth segment 2LC4 when located at the position C is from about 0 degree to about 26 degrees in the left, and from about 0 degree to about 5 degrees down (about 4 degrees to about 6 degrees down).

Figure 33:
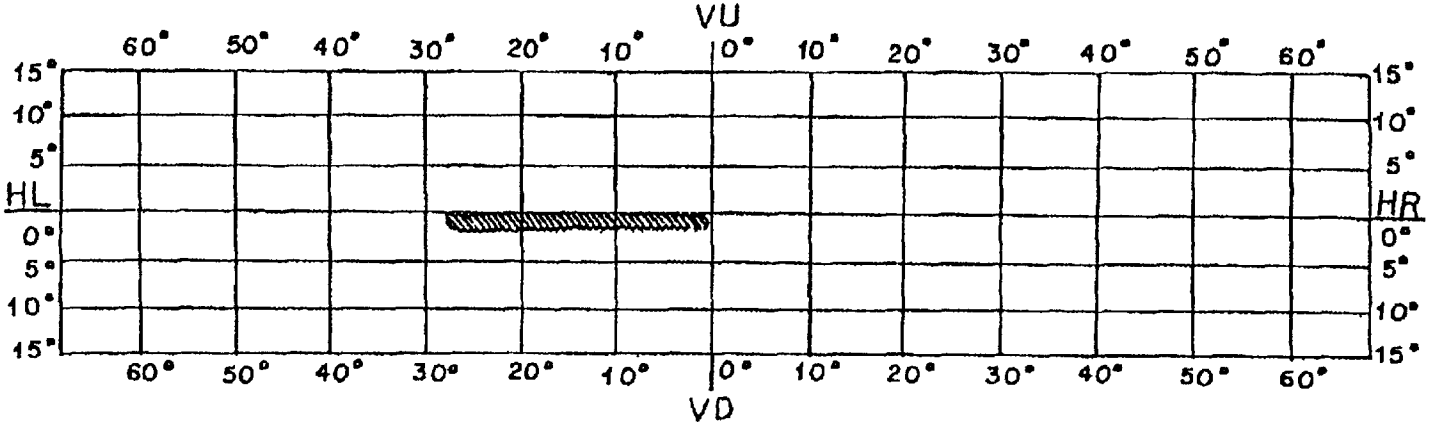
FIG. 33 is an explanatory diagram which shows a simplified luminous intensity distribution pattern of a fifth segment when the sub reflector of the left headlamp is located at the position C, which is a luminous intensity distribution pattern obtained by a computer simulation.

FIG. 33 shows a luminous intensity distribution pattern of a fifth segment 2LC5 (refer to FIG. 7) when the left sub reflector 2LC of the left headlamp 3L is located at the position C. This fifth segment 2LC5 is located at a fifth position from the above (that is, a lowest position). Therefore, when this segment illuminates an area below the left-and-right horizontal line HL-HR, there is an obstacle. Consequently, the fifth segment 2LC5 needs to extremely narrow the luminous intensity distribution pattern in up and down directions. Further, the fifth segment 2LC5 can condense the luminous intensity distribution patterns in left and right directions. Further, the fifth segment 2LC5 can bring the luminous intensity distribution pattern close to the up-and-down vertical line VU-VD. Further, the fifth segment 2LC5 can bring the luminous intensity distribution pattern close to the left-and-right horizontal line HL-HR. The range of the luminous intensity distribution pattern of the fifth segment 2LC5 when located at the position C is from about 0 degree to about 28 degrees in the left, and from about 0 degree to about 3 degrees down.

By combining the luminous intensity distribution patterns shown in FIG. 29 to FIG. 33 together, an auxiliary luminous intensity distribution pattern of a condensation type is formed when the left sub reflector 2LC of the left headlamp 3L (the sub reflector of the headlamp installed at the opposite side of the driving seat of the automobile) is located at the position C (the second position). The auxiliary luminous intensity distribution pattern of the condensation type is distributed to the left and right directions (from about 0 degree to about 33.5 degrees in the left) at the left side of the up-and-down vertical line VU-VD (at the opposite side of the driving seat). This auxiliary luminous intensity distribution pattern is also distributed to the up and down directions (from about 0 degree to about 13 degrees down) at a lower side of the left-and-right horizontal line HL-HR. As explained above, light is condensed and is irradiated positively in the above range, that is, the area at the opposite side of the driving seat. Therefore, the visibility of the range at the opposite side of the driving seat is improved, and it is possible to effectively utilize the light.

Figure 34:
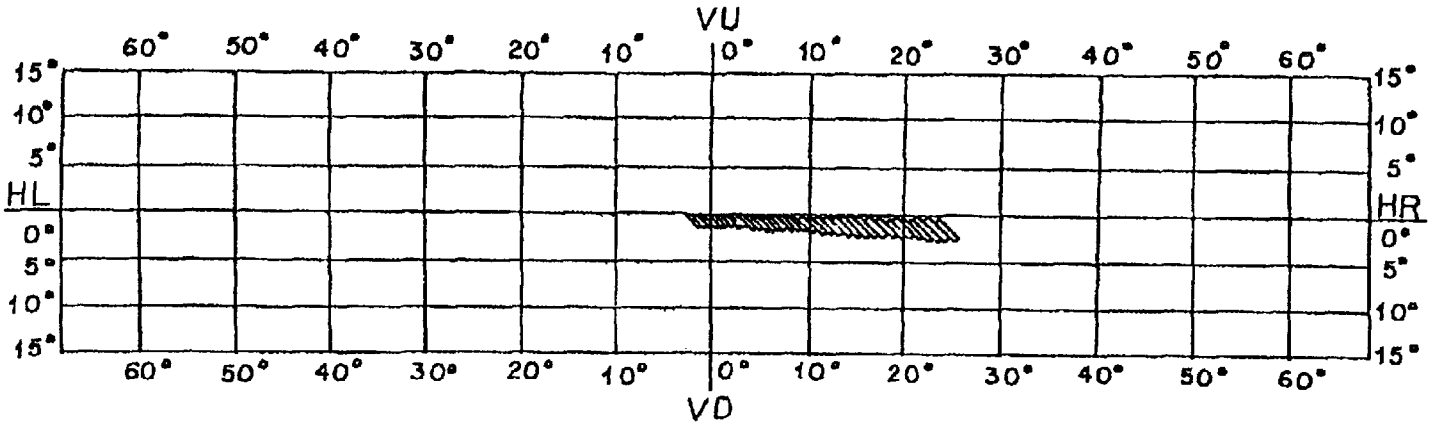
FIG. 34 is an explanatory diagram which shows a simplified luminous intensity distribution pattern of a first segment when the sub reflector of the right headlamp is located at the position C, which is a luminous intensity distribution pattern obtained by a computer simulation.

FIG. 34 shows a luminous intensity distribution pattern of a first segment 2RC1 (refer to FIG. 10) when the right sub reflector 2RC of the right headlamp 3R is located at the position C. This first segment 2RC1 is located at a highest position. Therefore, when this segment illuminates an area below the left-and-right horizontal line HL-HR, there is no obstacle. Consequently, the first segment 2RC1 can spread the luminous intensity distribution pattern in up and down directions but over an extremely narrow range. Further, the first segment 2RC1 can condense the luminous intensity distribution patterns in left and right directions. Further, the first segment 2RC1 can bring the luminous intensity distribution pattern close to the up-and-down vertical line VU-VD. Further, the first segment 2RC1 can bring the luminous intensity distribution pattern close to the left-and-right horizontal line HL-HR. The range of the luminous intensity distribution pattern of the first segment 2RC1 when located at the position C is from about 2 degrees in the left to about 25 degrees in the right, and from about 0 degree to about 2 degrees down (from about 1.5 degrees down to about 2.5 degrees down).

Figure 35:
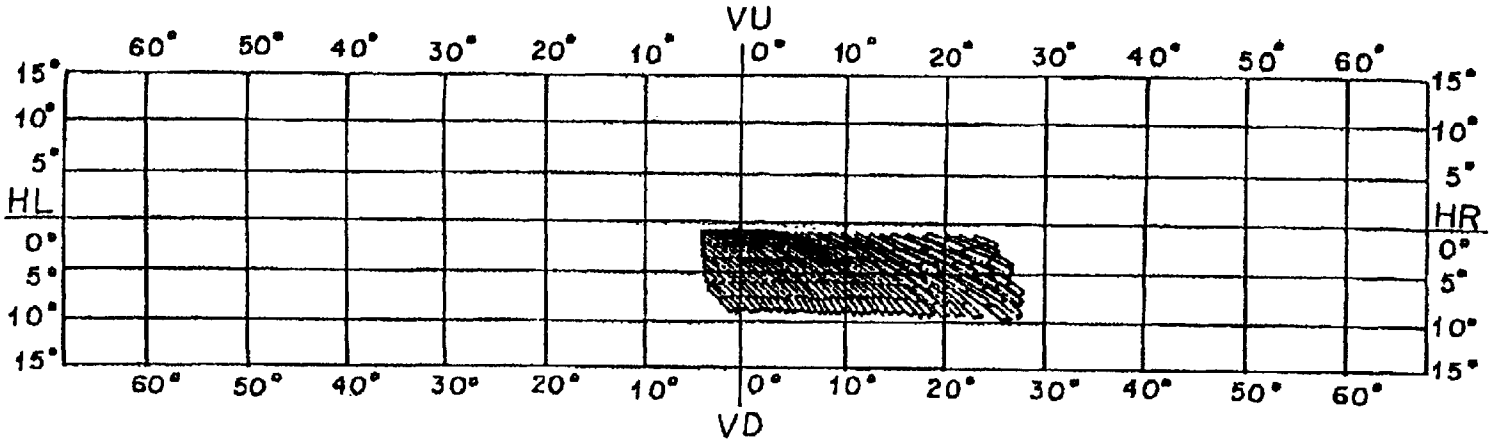
FIG. 35 is an explanatory diagram which shows a simplified luminous intensity distribution pattern of a second segment when the sub reflector of the right headlamp is located at the position C, which is a luminous intensity distribution pattern obtained by a computer simulation.

FIG. 35 shows a luminous intensity distribution pattern of a second segment 2RC2 (refer to FIG. 10) when the right sub reflector 2RC of the right headlamp 3R is located at the position C. This second segment 2RC2 is located at a second highest position. Therefore, when this segment illuminates an area below the left-and-right horizontal line HL-HR, there is no obstacle. Further, the light quantity from the light source 4 is large. Consequently, the second segment 2RC2 can spread the luminous intensity distribution pattern in up and down directions. Further, the second segment 2RC2 can condense the luminous intensity distribution patterns in left and right directions. Further, the second segment 2RC2 can bring the luminous intensity distribution pattern close to the up-and-down vertical line VU-VD. Further, the second segment 2RC2 can bring the luminous intensity distribution pattern close to the left-and-right horizontal line HL-HR. The range of the luminous intensity distribution pattern of the second segment 2RC2 when located at the position C is from about 4.5 degrees in the left to about 26.5 degrees in the right (about 25 degrees in the right to about 28 degrees in the right), and from about 1 degree down to about 9 degrees down.

Figure 36:
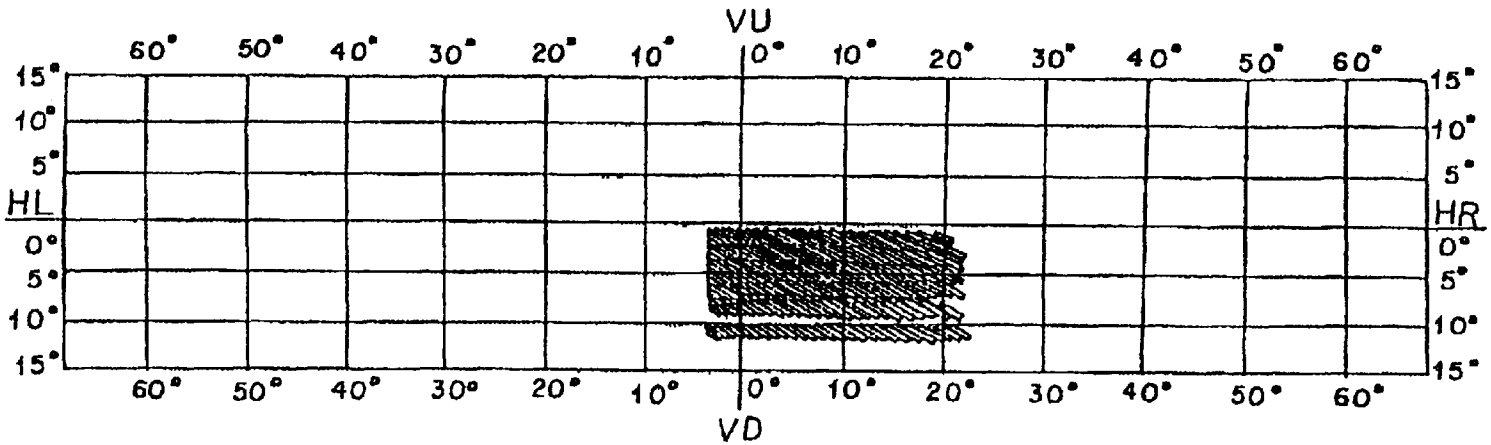
FIG. 36 is an explanatory diagram which shows a simplified luminous intensity distribution pattern of a third segment when the sub reflector of the right headlamp is located at the position C, which is a luminous intensity distribution pattern obtained by a computer simulation.

FIG. 36 shows a luminous intensity distribution pattern of a third segment 2RC3 (refer to FIG. 10) when the right sub reflector 2RC of the right headlamp 3R is located at the position C. This third segment 2RC3 is located at a third highest position. Therefore, when this segment illuminates an area below the left-and-right horizontal line HL-HR, there is no obstacle. Further, the light quantity from the light source 4 is largest. Consequently, the third segment 2RC3 can spread the luminous intensity distribution pattern in up and down directions. Further, the third segment 2RC3 can condense the luminous intensity distribution patterns in left and right directions. Further, the third segment 2RC3 can bring the luminous intensity distribution pattern close to the up-and-down vertical line VU-VD. Further, the third segment 2RC3 can bring the luminous intensity distribution pattern close to the left-and-right horizontal line HL-HR. The range of the luminous intensity distribution pattern of the third segment 2RC3 when located at the position C is from about 4 degrees in the left to about 22 degrees in the right, and from about 1 degrees down to about 12 degrees down.

Figure 37:
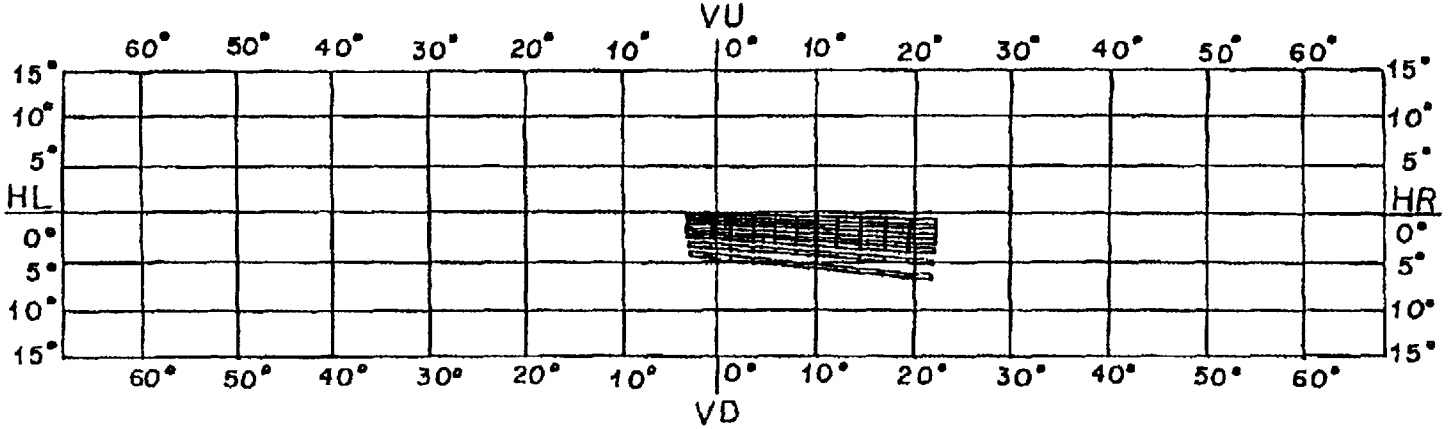
FIG. 37 is an explanatory diagram which shows a simplified luminous intensity distribution pattern of a fourth segment when the sub reflector of the left headlamp is located at the position C, which is a luminous intensity distribution pattern obtained by a computer simulation.

FIG. 37 shows a luminous intensity distribution pattern of a fourth segment 2RC4 (refer to FIG. 10) when the right sub reflector 2RC of the right headlamp 3R is located at the position C. This fourth segment 2RC4 is located at a fourth highest position. Therefore, when this segment illuminates an area below the left-and-right horizontal line HL-HR, there is an obstacle. Further, the light quantity from the light source 4 is large. Consequently, the fourth segment 2RC4 needs to narrow the luminous intensity distribution pattern in up and down directions. Further, the fourth segment 2RC4 can condense the luminous intensity distribution patterns in left and right directions. Further, the fourth segment 2RC4 can bring the luminous intensity distribution pattern close to the up-and-down vertical line VU-VD. Further, the fourth segment 2RC4 can bring the luminous intensity distribution pattern close to the left-and-right horizontal line HL-HR. The range of the luminous intensity distribution pattern of the fourth segment 2RC4 when located at the position C is from about 3 degrees in the left to about 22 degrees in the right, and from about 0 degree to about 5.5 degrees down (from about 4.5 degrees down to about 6.5 degrees down).

Figure 38:
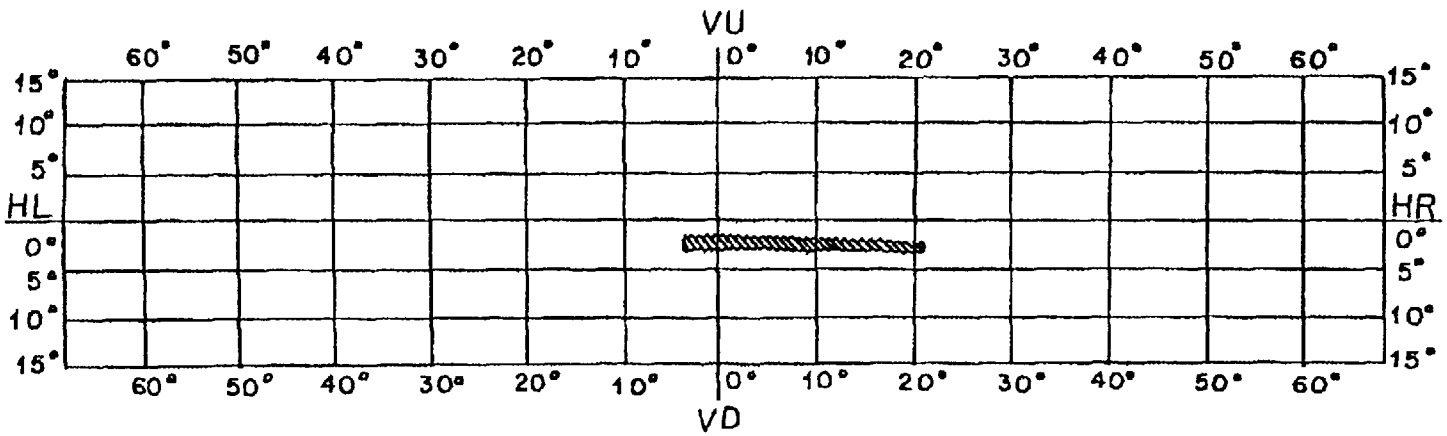
FIG. 38 is an explanatory diagram which shows a simplified luminous intensity distribution pattern of a fifth segment when the sub reflector of the left headlamp is located at the position C, which is a luminous intensity distribution pattern obtained by a computer simulation.

FIG. 38 shows a luminous intensity distribution pattern of a fifth segment 2RC5 (refer to FIG. 10) when the right sub reflector 2RC of the right headlamp 3R is located at the position C. This fifth segment 2RC5 is located at a fifth position from the above (that is, a lowest position). Therefore, when this segment illuminates an area below the left-and-right horizontal line HL-HR, there is an obstacle. Consequently, the fifth segment 2RC5 needs to extremely narrow the luminous intensity distribution pattern in up and down directions. Further, the fifth segment 2RC5 can condense the luminous intensity distribution patterns in left and right directions. Further, the fifth segment 2RC5 can bring the luminous intensity distribution pattern close to the up-and-down vertical line VU-VD. Further, the fifth segment 2RC5 can bring the luminous intensity distribution pattern close to the left-and-right horizontal line HL-HR. The range of the luminous intensity distribution pattern of the fifth segment 2RC5 when located at the position C is from about 3.5 degrees in the left to about 21 degrees in the right, and from about 1.5 degrees down to about 3.5 degrees down.

By combining the luminous intensity distribution patterns shown in FIG. 34 to FIG. 38 together, an auxiliary luminous intensity distribution pattern of a condensation type is formed when the right sub reflector 2RC of the right headlamp 3R (the sub reflector of the headlamp installed at the driving seat side of the automobile) is located at the position C (the second position). The auxiliary luminous intensity distribution pattern of the condensation type is distributed to the left and right directions (from about 4.5 degrees in the left to about 28 degrees in the right) with a small level at the left side of the up-and-down vertical line VU-VD (at the opposite side of the driving seat) and a large level at the right side of the up-and-down vertical line VU-VD (at the driving seat side). This luminous intensity distribution pattern is also distributed to the up and down directions (from about 0 degree to about 12 degrees down) at a lower side of the left-and-right horizontal line HL-HR. As explained above, light is condensed and is irradiated positively over the above range, mainly in the area at the driving seat side. Therefore, the visibility of the range mainly at the driving seat side is improved, and it is possible to effectively utilize the light.

The sub reflectors 2L and 2R are rotated continuously between the position A and the position C. Then, the luminous intensity distribution patterns of the segments of the sub reflectors 2L and 2R change continuously between the luminous intensity distribution patterns when the sub reflectors 2L and 2R are located at the position A (refer to FIG. 19 to FIG. 28) and the luminous intensity distribution patterns when the sub reflectors 2L and 2R are located at the position C (refer to FIG. 29 to FIG. 38).

As shown in FIG. 19 to FIG. 38, the reflection surfaces of free curved surfaces of the sub reflectors 2L and 2R (segments) are structured such that the image of the light source reflected above the reflection surface becomes larger than the image reflected below the reflection surface. For example, in the case of the left sub reflector 2LA located at the position A, the small square light source image reflected by the first segment 2LA1 located at the highest position (refer to FIG. 19) is slightly larger than the small square light source image reflected by the fifth segment 2LA5 located at the lowest position (refer to FIG. 23). Similarly, in the case of the right sub reflector 2RA located at the position A, the small square light source image reflected by the first segment 2RA1 located at the highest position (refer to FIG. 24) is slightly larger than the small square light source image reflected by the fifth segment 2RA5 located at the lowest position (refer to FIG. 28). Similarly, in the case of the left sub reflector 2LC located at the position C, the small square light source image reflected by the first segment 2LC1 located at the highest position (refer to FIG. 29) is slightly larger than the small square light source image reflected by the fifth segment 2LC5 located at the lowest position (refer to FIG. 33). Similarly, in the case of the right sub reflector 2RC located at the position C, the small square light source image reflected by the first segment 2RC1 located at the highest position (refer to FIG. 34) is slightly larger than the small square light source image reflected by the fifth segment 2RC5 located at the lowest position (refer to FIG. 38).

As explained above, according to one aspect of the headlamp relating to the present embodiment, the main reflectors 1L and 1R and the sub reflector 2L and 2R consisting of free curved surfaces respectively can obtain target luminous intensity distribution patterns.

According to another aspect of the headlamp relating to the present embodiment, the light from the light source is directly incident to the sub reflector, and the light from the light source is incident to the total reflection surface of the main reflector without being interrupted by the sub reflector. Therefore, it is possible to effectively utilize the light from the light source, as compared with the headlamp that forms a part of the main reflector as a reflection surface to reflect the light from the light source to the sub reflector (U.S. Pat. No. 5,060,120).

According to still another aspect of the headlamp relating to the present embodiment, the luminous intensity distribution patterns LSPA, LSPB, LSPC, RSPA, RSPB and RSPC of the sub reflectors 2L and 2R respectively are combined with the luminous intensity distribution patterns LMP and RMP of the main reflectors 1L and 1R. The combined luminous intensity distribution patterns LGPA, LGPB, LGPC, RGPA, RGPB and RGPC change continuously based on the move of the sub reflectors 2L and 2R respectively. Therefore, according to the headlamp relating to the present embodiment, it is possible to obtain luminous intensity distribution patterns that change continuously.

According to still another aspect of the headlamp relating to the present embodiment, the main reflectors 1L and 1R and the sub reflectors 2L and 2R are disposed in such a relationship that when the sub reflectors 2L and 2R move and are located at positions other than the position A, a part of the sub reflectors 2L and 2R is hidden at the backside of the main reflectors 1L and 1R respectively. Therefore, according to the headlamp relating to the present embodiment, when the sub reflectors 2L and 2R move and are located at positions other than the position A, a part of the sub reflectors 2L and 2R is hidden at the backside of the main reflectors 1L and 1R respectively. Therefore, according to the headlamp relating to the present embodiment, it is possible to optionally change large the luminous intensity distribution patterns LSPA, LSPB, LSPC, RSPA, RSPB and RSPC of the sub reflectors 2L and 2R respectively, and the combined luminous intensity distribution patterns LGPA, LGPB, LGPC, RGPA, RGPB and RGPC.

According to still another aspect of the headlamp relating to the present embodiment, the main reflectors 1L and 1R and the sub reflectors 2L and 2R reflect the light from the light source 4 to illuminate the road surface in the target luminous intensity distribution patterns. Therefore, according to the headlamp relating to the present embodiment, it is possible to effectively utilize the light from the light source 4, as compared with the headlamp that makes only the main reflector reflect the light from the light source.

Particularly, according to still another aspect of the headlamp relating to the present embodiment, it is possible to obtain combined luminous intensity distribution patterns that continuously change from the combined luminous intensity distribution patterns LGPA and RGPA of the spread type to the combined luminous intensity distribution patterns LGPC and RGPC of the condensation type. Therefore, according to the headlamp relating to the present embodiment, it is possible to obtain luminous intensity distribution patterns which provide satisfactory visibility suitable for the running on the left curve or the right curve (during the running on a mountain road or a winding road), the running on a town road (during the running on the crossing), and the running at a high speed.

According to still another aspect of the headlamp relating to the present embodiment, when the sub reflectors 2L and 2R are located at the position A, the whole reflection surfaces of the sub reflectors 2L and 2R are used. Therefore, it is possible to obtain easily and securely the combined luminous intensity distribution patterns LGPA and RGPA of the spread type that provide wide and bright patterns. Further, according to the headlamp relating to the present embodiment, when the sub reflectors 2L and 2R are located at the position C, a part of the sub reflectors 2L and 2R is hidden at the backside of the main reflectors 1L and 1R respectively, and other portions of the sub reflectors 2L and 2R are used. Therefore, it is possible to obtain easily and securely the combined luminous intensity distribution patterns LGPC and RGPC of the condensation type that provide high brightness at the center portion.

According to still another aspect of the headlamp relating to the present embodiment, the reflection surfaces of the sub reflectors 2L and 2R form convex shapes. Therefore, the light paths of the reflection surfaces become open. As a result, according to the headlamp relating to the present embodiment, it is possible to easily execute the control of spreading the reflection light by using the whole reflection surfaces of the sub reflectors 2L and 2R and the control of condensing the reflection light by using other portions of the reflection surfaces of the sub reflectors 2L and 2R, as compared with the cross reflection light path.

According to still another aspect of the headlamp relating to the present embodiment, the light source image reflected at the upper portion of the sub reflectors 2L and 2R respectively is slightly larger than the image reflected at the lower portion of the sub reflectors 2L and 2R respectively. Therefore, according to the headlamp relating to the present embodiment, the light reflected at the lower portion of the sub reflectors 2L and 2R is not so much interrupted by the lower wall of the main reflectors 1L and 2R respectively. As a result, it is possible to effectively utilize the light from the light source 4 by that amount.

According to still another aspect of the headlamp relating to the present embodiment, the sub reflectors 2L and 2R are movably disposed at the center side of the automobile C. Therefore, according to the headlamp relating to the present embodiment, it is possible to obtain a wide space at the center side of the front of the automobile C when the front forms a slanted shape from the center backward at both left and right ends of the automobile C. As a result, according to the headlamp relating to the present embodiment, it is possible to move the sub reflectors 2L and 2R within a certain level of freedom in the wide space. In other words, the degree of freedom of designing the sub reflectors 2L and 2R is large.

According to the present embodiment, the headlamp of the present invention is used for the left headlamp 3L and the right headlamp 3R that are installed on both left and right sides respectively of the front of the automobile. According to the present invention, it is also possible to use the headlamp of the present invention for any one of the left headlamp and the right headlamp. In other words, it is also possible to change the luminous intensity distribution pattern, by moving the sub reflector of any one of the left headlamp and the right headlamp.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

The entire contents of Japenese Patent Application No. 2001-177740, filed Jun. 12, 2001, from which the present application claims priority, is incorporated herein by reference.

What is claimed is:

1. A headlamp that is installed at the front of an automobile and that illuminates a road surface and the like, wherein the headlamp comprises a light source, a main reflector, and a sub reflector, and when the light source is turned on, the headlamp reflects the light from the light source with the main reflector and the sub reflector to illuminate the road surface and the like in a target luminous intensity distribution pattern, and changes the luminous intensity distribution pattern by moving the sub reflector, the main reflector and the sub reflector are prepared based on a composite combination of reflection surfaces of free curved surfaces, and the sub reflector is movably disposed at a position where the light from the light source is directly incident to the sub reflector, and also at the position where the sub reflector does not interrupt a light path through which the light from the light source is incident to the main reflector, wherein the main reflector and the sub reflector are disposed in such a relationship when the sub reflector moves and is located at a position other than a first position, a part of the sub reflector is hidden at the backside of the main reflector, and the light from the light source is not incident to the hidden portion of the sub reflector.

2. The headlamp according to claim 1, wherein the reflection surface of free curved surfaces of the sub reflector has a convex shape.

3. The headlamp according to claim 1, wherein the reflection surface of free curved surfaces of the sub reflector is structured such that the light source image reflected at an upper portion of the reflection surface is slightly larger than the light source image reflected at a lower portion of the reflection surface.

4. The headlamp according to claim 1, wherein the sub reflector is movably disposed at the center side of the automobile.

5. The headlamp according to claim 1, wherein the main reflector is constructed of a plurality of segments, and a luminous intensity distribution pattern obtained by the main reflector is a luminous intensity distribution pattern of a meeting mode that satisfies various standards.

6. The headlamp according to claim 1, wherein the sub reflector is constructed of a plurality of segments in up and down directions.

7. The headlamp according to claim 1, wherein the sub reflector is moved by at least one selected from a group consisting of a motor, a solenoid, and an air cylinder.

8. The headlamp according to claim 1, wherein a control unit that controls the move of the sub reflector is a manual switch based on a hand operation of a driver or an automatic switch that is linked with a steering sensor or a speed sensor.

9. The headlamp according to claim 1, wherein the sub reflector of the headlamp installed at the driving seat side of the automobile forms an auxiliary luminous intensity distribution pattern of a spread type that is spread wide to the left and right directions at the driving seat side of a vertical line and is also spread wide to the up and down directions at a lower side of a horizontal line, when the sub reflector is located at a first position.

10. The headlamp according to claim 1, wherein the sub reflector of the headlamp installed at the driving seat side of the automobile forms an auxiliary luminous intensity distribution pattern of a concentration type that is distributed to the left and right directions to a small level at the opposite side of the driving seat from the vertical line, and to a large level at the driving seat side from the vertical line, and is also distributed to the up and down directions at a lower side of a horizontal line, when the sub reflector is located at a second position.

11. The headlamp according to claim 1, wherein the sub reflector of the headlamp installed at the opposite side of the driving seat of the automobile forms an auxiliary luminous intensity distribution pattern of a spread type that is spread to the left and right directions at the opposite side of the driving seat from the vertical line, and is also spread to the up and down directions at a lower side of a horizontal line, when the sub reflector is located at a first position.

12. The headlamp according to claim 1, wherein the sub reflector of the headlamp installed at the opposite side of the driving seat of the automobile forms an auxiliary luminous intensity distribution pattern of a condensation type that is distributed to the left and right directions at the opposite side of the driving seat from the vertical line, and is also distributed to the up and down directions at a lower side of a horizontal line, when the sub reflector is located at a second position.

13. The headlamp according to claim 1, wherein the sub reflector is a single sub reflector, and when the headlamp is installed on leftside at the front of the automobile, the sub reflector is disposed on the right side of the main reflector, and when the headlamp is installed on the rightside at the front of the automobile, the sub reflector is disposed on the left side of the main reflector, so that the sub reflector is disposed at the center side of the automobile.

14. The headlamp according to claim 13, wherein when the automobile turns a left curve, the left sub reflector of the left headlamp is located at the first position, and the right sub reflector of the right headlamp is located at the second position.

15. The headlamp according to claim 13, wherein when the automobile turns a right curve, the left sub reflector of the left headlamp is located at the second position, and the right sub reflector of the right headlamp is located at the first position.

16. The headlamp according to claim 13, wherein when the automobile runs on a town road, the left sub reflector of the left headlamp and the right sub reflector of the right headlamp are located at the first position respectively.

17. The headlamp according to claim 13, wherein when the automobile runs at a high speed, the left sub reflector of the left headlamp and the right sub reflector of the right headlamp are located at the second position respectively.

18. The headlamp that is installed at the front of an automobile and that illuminates a road surface and the like, wherein the headlamp comprises a light source, a main reflector, and a sub reflector, and when the light source is turned on, the headlamp reflects the light from the light source with the main reflector and the sub reflector to illuminate the road surface and the like in a target luminous intensity distribution pattern, and changes the luminous intensity distribution pattern by moving the sub reflector, the main reflector and the sub reflector are prepared based on a composite combination of reflection surfaces of free curved surfaces, and the sub reflector is movably disposed at a position where the light from the light source is directly incident to the sub reflector, and also at the position where the sub reflector does not interrupt a light path through which the light from the light source is incident to the main reflector, wherein a basic luminous intensity distribution pattern obtained by the main reflector and an auxiliary luminous intensity distribution pattern obtained by the sub reflector are combined together, and a combined luminous intensity distribution pattern as the target luminous intensity distribution pattern is obtained, the combined luminous intensity distribution pattern includes:

a combined luminous intensity distribution pattern of a spread type that is obtained when the sub reflector is located at a first position, and that has a right end portion or a left end portion of an auxiliary luminous intensity distribution pattern superimposed with the left end portion or the right end portion of the basic luminous intensity distribution pattern and, and has the left end portion or the right end portion of the auxiliary luminous intensity distribution pattern spread to the leftside or the rightside;

a combined luminous intensity distribution pattern of a condensation type that is obtained when the sub reflector is located at a second position, and that has the left end portion or the right end portion of the auxiliary luminous intensity distribution pattern cut, and has the right end portion or the left end portion of the auxiliary luminous intensity distribution pattern superimposed with substantially a center portion of the basic luminous intensity distribution pattern; and a combined luminous intensity distribution pattern that is obtained when the sub reflector is located between the first position and the second position, and that is a combined luminous intensity distribution pattern of an intermediate type between the combined luminous intensity distribution pattern of the spread type and the combined luminous intensity distribution pattern of the condensation type, wherein the headlamp obtains combined luminous intensity distribution patterns that continuously change between the combined luminous intensity distribution pattern of the spread type and the combined luminous intensity distribution pattern of the condensation type, by continuously moving the sub reflector between the first position and the second position, and wherein the sub reflector is rotatably disposed between the first position and the second position around a vertical rotation axis in the vicinity of the light source, and when the sub reflector rotates from the first position to the second position, a part of the sub reflector is hidden at the backside of the main reflector, and the left end portion or the right end portion of the auxiliary luminous intensity distribution pattern is cut.

19. An automobile headlamp having a main reflector and a movable sub-reflector, the headlamp comprising:

a light source;

a main reflector that reflects light from the light source when the light source is turned on; and a movable sub-reflector that reflects the light so as to form a target luminous intensity distribution pattern with the main reflector, and that changes the luminous intensity distribution pattern when moved, wherein the main reflector and sub-reflector are prepared based on a composite combination of reflection surfaces of free curved surfaces, and the sub-reflector is movably disposed between a first position where the light is directly incident on the sub-reflector preventing a light path through which the light is incident on the main reflector from being interrupted by the sub-reflector, and a second position where a part of the sub-reflector is hidden at the backside of the main reflector, wherein movement of the sub-reflector changes the luminous intensity distribution pattern to suit different conditions.

20. An automobile headlamp, comprising:

a light source;

a main reflector that reflects light from the light source when the light source is turned on; and a movable sub-reflector that reflects the light so as to form a target luminous intensity distribution pattern with the main reflector, and that changes the luminous intensity distribution pattern when moved, wherein the main reflector and sub-reflector are prepared based on a composite combination of reflection surfaces of free curved surfaces, and wherein the sub-reflector is movably disposed between a first position in which the sub-reflector is not hidden by the main reflector and a second position in which at least a part of the sub-reflector is hidden at the backside of the main reflector.

* * * * *